US006101961A

United States Patent [19]

Sakuma

[11] Patent Number: 6,101,961

[45] Date of Patent: Aug. 15, 2000

[54] THREAD FEEDING APPARATUS FOR SEWING MACHINE

[75] Inventor: Kouichi Sakuma, Yamagata, Japan

[73] Assignee: Suzuki Manufacturing Co., Ltd., Japan

[21] Appl. No.: 09/252,018

[22] Filed: Feb. 18, 1999

Related U.S. Application Data

[63] Continuation of application No. 08/972,263, Nov. 18, 1997, Pat. No. 5,934,211.

[30] Foreign Application Priority Data

Mar. 31, 1997 [JP] Japan ..... 9-81388

[51] Int. Cl.[7] ..... D05B 47/04

[52] U.S. Cl. ..... 112/255

[58] Field of Search ..... 112/302, 254, 112/255, 162, 166, 475.26

[56] References Cited

U.S. PATENT DOCUMENTS

| | | | |
|---|---|---|---|
| 3,628,480 | 12/1971 | Van Ness | 112/255 X |
| 4,215,641 | 8/1980 | Dobryanskyj et al. | 112/255 X |
| 5,138,961 | 8/1992 | Nakano et al. | 112/255 X |
| 5,404,824 | 4/1995 | Hiraoka et al. | 112/254 |
| 5,934,211 | 8/1999 | Sakuma | 112/255 |

FOREIGN PATENT DOCUMENTS

| | | | |
|---|---|---|---|
| 1652407 | 5/1991 | Russian Federation | 112/154 |

*Primary Examiner*—Ismael Izaguirre
*Attorney, Agent, or Firm*—Lorusso & Loud

[57] ABSTRACT

A thread feeding apparatus for a sewing machine which has a simplified mechanism for accuracy of manufacturing and improved durability so as to accommodate high speed sewing. The thread feeding apparatus for the sewing machine has upstream grippers for respectively gripping an upper looper thread and a lower looper thread, closed by a stitch forming device at the time of the stitch forming and opened at the time of the cloth feeding, downstream grippers for gripping the respective threads introduced from the respective upstream grippers, opened at the time of the stitch forming so that the respective threads are pulled by the stitch forming device and closed at the time of cloth feeding, and reciprocators which are respectively driven in a synchronous manner with a left needle, a right needle, an upper looper and a lower looper, at the time of cloth feeding. The reciprocators shift the respective threads in thread paths extending between the respective opened upstream grippers and the respective closed downstream grippers to pull off a thread quantity necessary for forming a stitch and, at the time of stitch forming, release the respective threads.

3 Claims, 23 Drawing Sheets

DOUBLE NEEDLE OVERLOCK SEWING

THREAD FEEDING APPARATUS FOR SEWING MACHINE

CROSS REFERENCE TO RELATED APPLICATION

This application is a continuation of U.S. Ser. No. 08/972,263, filed Nov. 18, 1997, allowed as U.S. Pat. No. 5,934,211.

BACKGROUND OF THE INVENTION

1. Field of the Invention

The present invention relates to a thread feeding apparatus for a sewing machine, and particularly to a thread feeding apparatus for sewing machine in which a thread can be supplied to a stitch forming device for forming a stitch in a cloth without necessity of an operation of a stitch balancing thread tension.

2. Description of the Prior Art

The conventional lock stitch sewing machine or overlock sewing machine is provided with a thread tension device comprising a pair of thread tension discs held between thread tension springs at a predetermined pressing force, thereby holding a thread between the thread tension discs and adjusting a tensional force generated in the thread, at the time of forming a stitch by a needle or a looper, to a predetermined value by means of the thread tension device so that a stitch can be neatly finished even if the type and thickness of the thread is changed. In this case, feeding of the thread is performed by drawing by the thread tension device together with a needle thread take up or a looper thread take up and tightening stitches. In these sewing machines, a significantly complicated manual operation input for adjusting the thread tension device is necessary. Particularly, in the overlock sewing machine, since the number of threads is increased, it is significantly complicated to obtain a good balance of the tension between the threads.

Further, there is known a computer controlled overlock sewing machine which is provided with a pair of rollers each having an encoder and an electromagnetic thread gripper so that the encoder measures a length of the thread, thereby opening and closing each of the electromagnetic thread grippers so as to supply a thread quantity necessary for forming a stitch (Japanese Patent Unexamined Publication No. 2-45088). The computer controlled overlock sewing machine has a complex mechanism and requires a manual operation for prior input of data concerning the type of the thread, thickness of the thread, cloth thickness, stitch width and the like, so as to determine the quantity of the thread, creating the problem that it is difficult to correlate the manual input to the finish of the stitch. Still further, in the computer controlled overlook sewing machine, since the roller forcibly supplies the thread even when the thread is cut thread waste is fed.

In order to solve the above problem, the applicant of this application has suggested a thread feeding apparatus for a sewing machine which can provide a suitable stitch balancing thread tension (Japanese Patent Unexamined Publication No. 9-19583). Since the thread feeding apparatus for a sewing machine employs a thread storing device which stores a thread quantity necessary for a stitch and removes the thread at the time of stitch forming, there are the problems that the mechanism becomes complex so that it is difficult to provide accuracy in manufacturing, durability thereof is low and the apparatus can not provide high speed sewing. Further, the thread feeding apparatus for a sewing machine can not satisfy consumer demand for a number of needles and a narrow hem or rolled hem sewing.

SUMMARY OF THE INVENTION

The present invention is achieved for the purpose of satisfying the above conventional requirements and an object of the present invention is to provide a thread feeding apparatus for a sewing machine which has a simplified mechanism so that accuracy in manufacturing can be secured, which has durability and which can satisfy requirements for high speed sewing.

In order to achieve the above object, in accordance with the present invention, there is provided a thread feeding apparatus for a sewing machine which feeds a thread to a stitch forming device for forming a stitch in a cloth, the thread feeding apparatus comprising: an upstream gripper gripping the thread fed from a thread spool, closed by the stitch forming device at the time of forming the stitch and opened at the time of feeding of the cloth; a downstream gripper gripping the thread introduced from the upstream gripper, opened at the time of the stitch forming so that the thread is pulled by the stitch forming device and closed at the time of feeding of the cloth; and a reciprocator synchronously driven with the stitch forming device, shifting the thread in a thread path extending between the opened upstream gripper and the closed downstream gripper at the time of feeding of the cloth as a thread quantity necessary for one stitch of the stitch forming device, and releasing the thread at the time of forming the stitch.

Further, in the thread feeding apparatus for a sewing machine in accordance with the present invention, it is preferable that the reciprocators be disposed between a pair of thread guides arranged between the upstream gripper and the downstream gripper in a spaced relation to a thread feeding direction and that the reciprocators have a sloped cut for introducing the thread from an inlet port to a point aligning the thread path with the pair of thread guides.

Still further, in a thread feeding apparatus for a sewing machine in accordance with the present invention, it is preferable that the thread feeding apparatus include a shifter for adjusting a shift quantity of thread shifted by the reciprocator to correspond to the thread quantity necessary for one stitch, which shift quantity changes in response to change in stitch width, stitch length and/or a cloth thickness.

Furthermore, in accordance with the present invention, there is provided a thread feeding apparatus for a sewing machine which feeds a needle thread, an upper looper thread and a lower looper thread to a needle, an upper looper and a lower looper, respectively, of a stitch forming device for forming a stitch in a cloth, the thread feeding apparatus including: a needle thread upstream gripper, an upper looper thread upstream gripper and a lower looper upstream gripper gripping the needle thread, the upper looper thread and the lower looper thread respectively fed from thread spools, which are closed by the stitch forming device at the time of forming a stitch and opened at the time of feeding of the cloth. The thread feeding apparatus further includes a needle thread downstream gripper, an upper looper thread downstream gripper and a lower looper downstream gripper gripping the needle thread, the upper looper thread and the lower looper thread respectively fed thereto from the needle thread upstream gripper, the upper looper upstream gripper and the lower looper upstream gripper, which are opened at the time of stitch forming so that the needle thread, the upper looper thread and the lower looper thread can be pulled by the stitch forming device and closed at the time of cloth feeding. A needle thread reciprocator, an upper looper thread reciprocator and a lower looper thread reciprocator are synchronously driven with the needle, the upper looper and the lower looper, respectively, shifting the needle thread, the upper looper thread and the lower looper thread in thread paths respectively extending between the opened needle thread upstream gripper and the closed needle thread downstream gripper, between the opened upper looper thread upstream gripper and the closed upper looper thread downstream gripper and between the opened lower looper thread upstream gripper and the closed lower looper thread downstream gripper. These reciprocators operate at the time of cloth feeding to take up quantities of the respective threads necessary for forming one stitch of the stitch forming device, and release the threads at the time of forming the stitch.

In one preferred embodiment, a needle thread shifter, an upper looper thread shifter and a lower looper thread shifter respectively adjust the shift quantity of thread shifted by the needle thread reciprocator, the upper looper thread reciprocator and the lower looper thread reciprocator to correspond to changes in the thread quantity necessary for one stitch due to changes in stitch width, stitch length and/or a cloth thickness. This preferred embodiment also includes a change-over means for displacing the needle thread shifter, the upper looper thread shifter and the lower looper thread shifter in correspondence to the number of the needles and/or stitch width.

In another preferred embodiment, the change-over means respectively displaces the upper looper thread shifter and the lower looper thread shifter in such a manner that, in narrow hem sewing, the shifted quantity of the upper looper thread necessary for one stitch becomes equal to the shifted quantity of the lower thread necessary for one stitch and, in rolled hem sewing, in such a manner that the shifted quantity of the upper looper thread necessary for one stitch is increased and the shifted quantity of the lower looper thread is decreased.

In the above described sewing machine, at the time of feeding a cloth, since the upstream gripper is opened together with the stitch forming device in an interlocked manner and the downstream gripper is closed, during this period, the reciprocator shifts the thread of the thread path extending between the upstream gripper and the downstream gripper, thereby securing the thread quantity necessary for forming a stitch. Further, at the time of stitch forming, since the upstream gripper is closed together with the stitch forming device in an interlocked manner and the downstream gripper is opened, during this period, the reciprocator releases the thread of the thread path extending between the upstream gripper and the downstream gripper, thereby feeding the thread quantity necessary for forming a stitch.

In this case, in order for the thread feed to correspond to the thread quantity necessary for one stitch which changes with change in stitch width, stitch length and/or a cloth thickness, the shifter can adjust the quantity of thread fed by the reciprocator.

DESCRIPTION OF THE PREFERRED EMBODIMENTS

An embodiment of a thread feeding apparatus for a sewing machine in accordance with the present invention will be explained below with reference to the accompanying drawings which show an embodiment of an overlock sewing machine having two needles and four threads.

Figure 1:
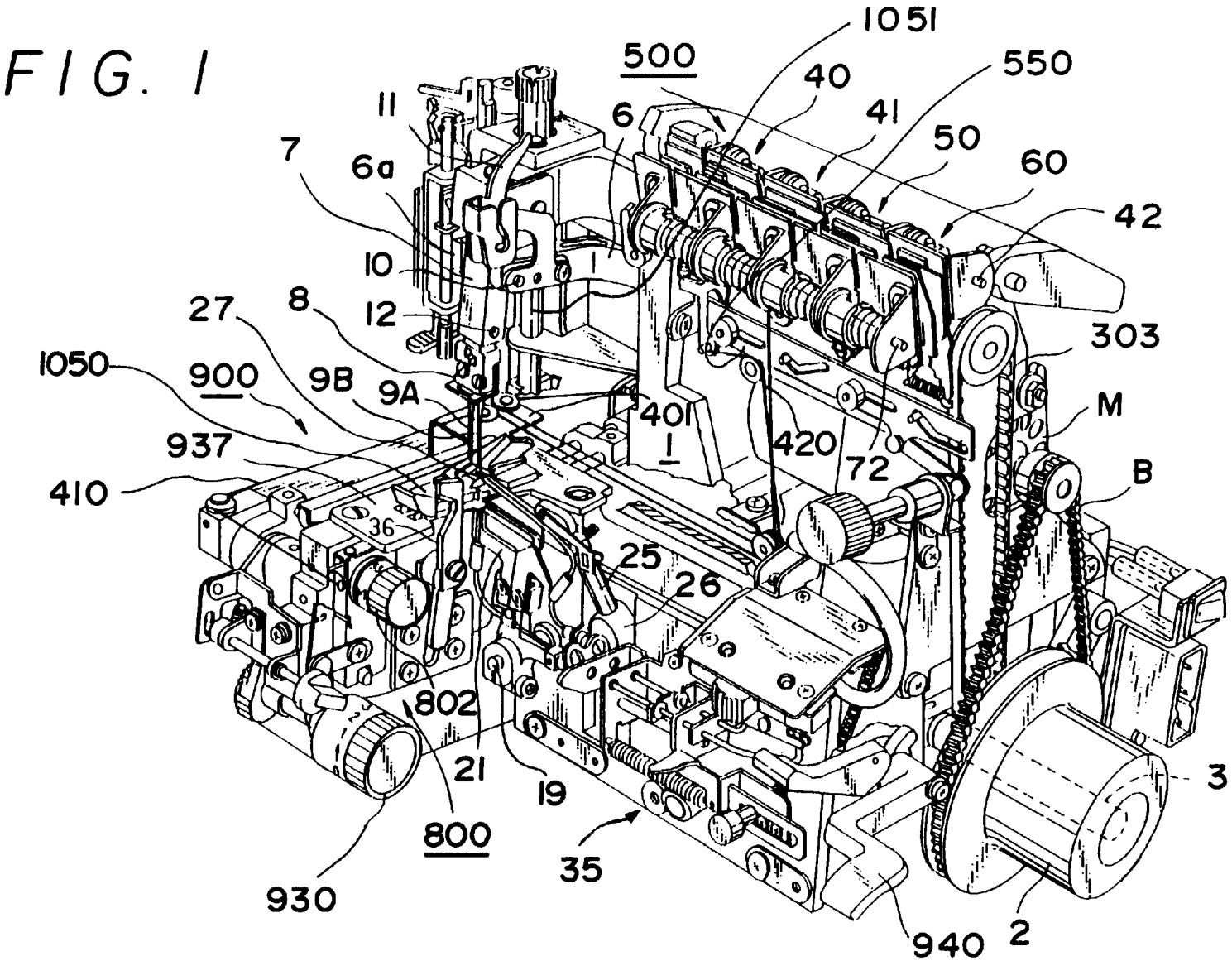
FIG. 1 is a perspective view which shows an overlock sewing machine incorporating a thread feeding apparatus in accordance with the present invention.

The overlock sewing machine having two needles and four threads, as shown in FIG. 1, has a driving shaft 3 fixed to a hand wheel 2 which is axially supported by machine casing 1. The hand wheel 2 is rotated by a motor M through a timing belt B.

The drive shaft 3 is provided with a needle driving eccentric cam 4 (referring to FIG. 2) and a lower end portion of a needle driving rod 5 (referring to FIG. 2) serving as a cam follower is pivotally attached to the needle driving eccentric cam 4. Further, the other end of the needle driving rod 5 is pivotally attached to a needle driving arm 6 pivotally supported by the machine casing 1. A needle clamp link 7 is pivotally supported on a U-shaped front end portion 6*a* of the needle driving arm 6 by a connecting pin 10. The needle clamp link 7 is pivotally attached to a needle clamp body 8, which is slidably mounted on a guide rod 11 fixed to the machine casing 1, by a connecting pin 12. A left needle 9A and a right needle 9B are fixed to the needle clamp body 8.

Figure 2:
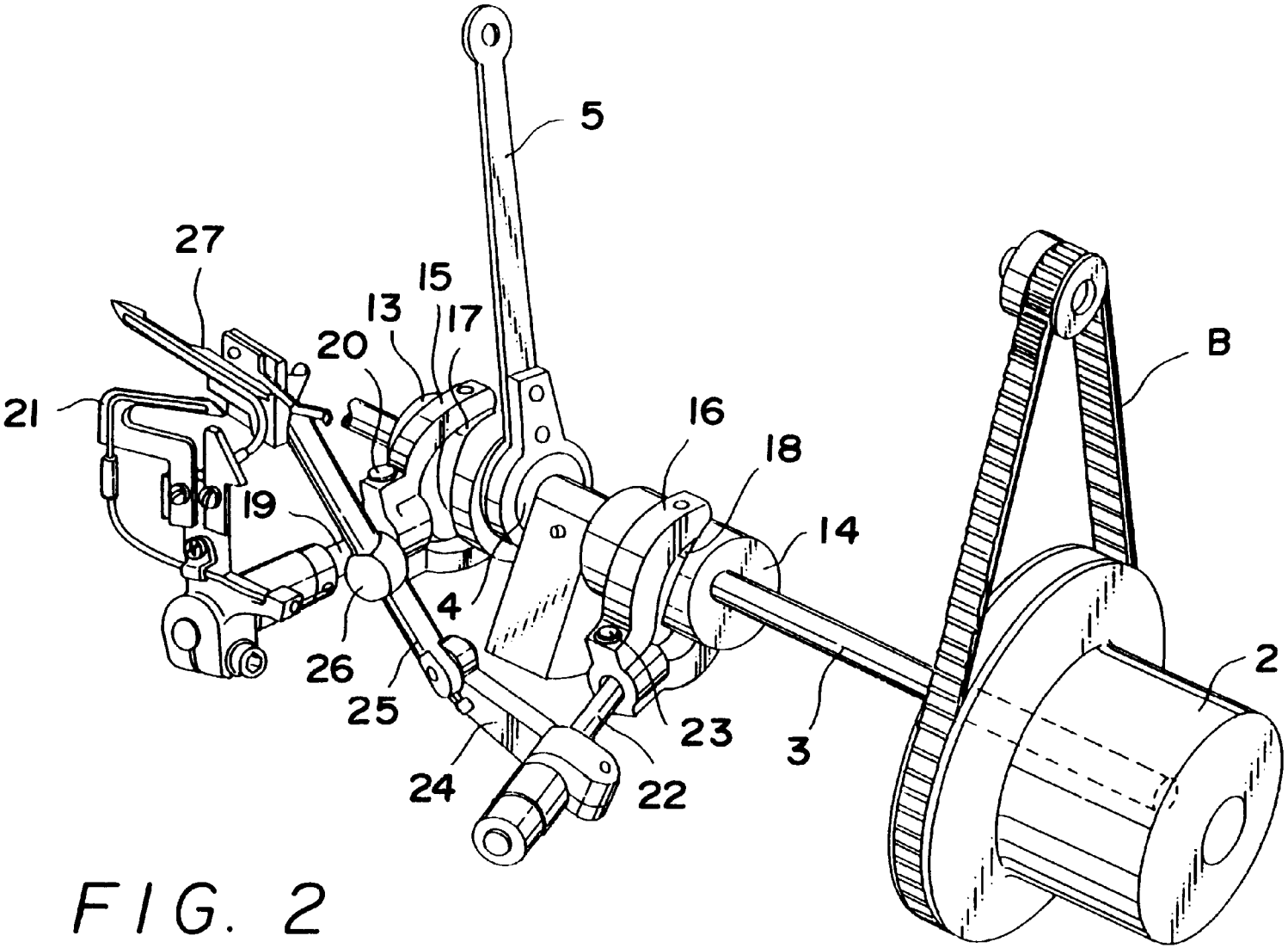
FIG. 2 is a perspective view which shows a mechanism for driving an upper looper and a lower looper of the overlook sewing machine in FIG. 1.

Further, a lower looper driving inclined cam 13 and a upper looper driving inclined cam 14 are fixed to the drive shaft 3 as shown in FIG. 2, and rollers 17 and 18 which correspond to cam followers and are respectively mounted on a lower looper driving fork 15 and an upper looper driving fork 16 are engaged with the lower looper driving inclined cam 13 and the upper looper driving inclined cam 14. The lower looper driving fork 15 is pivotally attached to a lower looper drive shaft 19 by a pin 20. A lower looper 21 is fixed to the lower looper drive shaft 19. The upper looper driving fork 16 is pivotally attached to a upper looper drive shaft 22 by a pin 23. An end of an upper looper drive arm 24 is fixed to the upper looper drive shaft 22 and an upper looper mounting shaft 25 is pivotally attached to the other end of the upper looper drive arm 24. The upper looper mounting shaft 25 is axially supported at a pivot 26 rotatably mounted on the machine casing 1 in a slidable manner. An upper looper 27 is fixed to an upper end of the upper looper mounting shaft 25.

Figure 3:
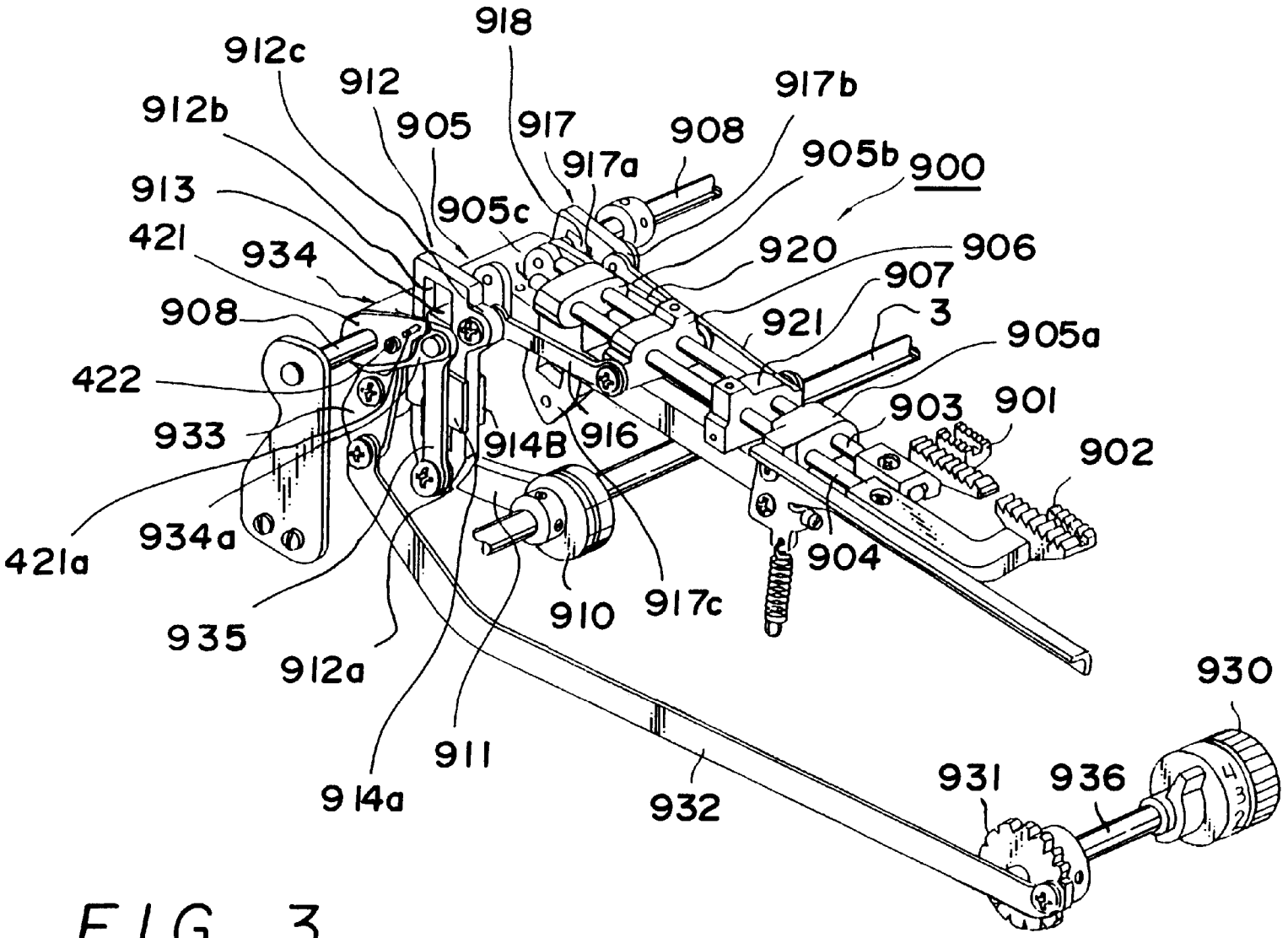
FIG. 3 is a perspective view which shows a mechanism of an adjusting portion for stitch feeding in the overlook sewing machine of FIG. 1.

As shown in FIG. 3, a horizontal feeding cam 910, corresponding to a part of a stitch feed adjusting mechanism 900, is fixed to the drive shaft 3. The stitch feed adjusting mechanism 900 is fixed to a main feed gear mounting shaft 903 and a sub feed gear mounting shaft 904 in such a manner that a main feed gear 901 and a sub feed gear 902 respectively move in front and in the rear in a cloth feeding direction, and the main feed gear mounting shaft 903 and the sub feed gear mounting shaft 904 are slidably supported by two support portions 905*a* and 905*b* of a feed base plate 905. A main feed drive body 906 and a sub feed drive body 907 are fitted to the main feed gear mounting shaft 903 and the sub feed gear mounting shaft 904, and the main feed gear mounting shaft 903 is fixed to the main feed drive body 906 and is slidable with respect to the sub feed drive body 907. Similarly, the sub feed gear mounting shaft 904 is fixed to the sub feed drive body 907 and is slidable with respect to the main feed drive body 906. The feed base plate 905 supporting these members has a cylindrical boss portion 905*c* and is supported on a base plate shaft 908 through this boss portion 905*c*. The base plate shaft 908 is pivotally supported by the machine casing 1.

A horizontal feeding rod 911 is fitted to the horizontal feeding cam 910 fixed to the drive shaft 3. An end of the horizontal feeding rod 911 is connected to an end 912*a* of a main feeding drive arm 912 and a main feeding slide rod 913 is slidably supported within a rectangular hole 912*b* of the main feeding drive arm 912 in such a manner as to be held between two stop plates 914A and 914B. The main feeding slide rod 913 is supported by the feed base plate 905 at a position close to the cylindrical boss portion 905*c* by a swing shaft (not shown). The other end 912*c* of the main feeding drive arm 912 is connected to the main feeding drive body 906 fixed to the main feeding gear mounting shaft 903 through a main feeding link 916.

Further, a sub feeding slide rod 918 is supported by the feeding base plate 905 through a swing shaft located on its side opposite the main feeding drive arm 912. The sub feeding slide rod 918 is slidably supported within two rectangular holes 917*a* of a sub feeding drive arm 917 in such a manner as to be held between two stop plates (not shown). A connecting rod 920, which transmits swing motion of the main feeding slide rod 913 and the main feeding drive arm 912, is connected to the sub feeding drive arm 917 and to the main feeding drive body 906.

One end 917*b* of the sub feeding drive arm 917 is connected to the sub feeding drive body 907 (fixed to the sub feed gear mounting shaft 904) through a sub feeding link 921.

The stitch feed adjusting device 900 described above is provided with a feed quantity adjusting dial 930 for adjusting a main feed. The feed quantity adjusting dial 930 is fixed to a substantially half circular plate 931 through a feed dial shaft 936 and the substantially half circular plate 931 is connected to an adjusting arm 934 through a link 932 and an adjusting plate 933. The adjusting arm 934 is axially supported by the base plate shaft 908 and an arm portion 934*a* is connected to the one end 912*a* of the main feeding drive arm 912 through an adjusting link 935. Further, a stitch feed adjusting arm 421 of a thread tension fine adjusting means 400 (to be described below) is fixed to the adjusting arm 934 by a fixing screw 422. A differential adjusting lever 940 (referring to FIG. 1) is provided for adjusting a sub feed. The differential adjusting lever 940 (see FIGS. 1 and 5) is connected to the other end 917*c* of the sub feeding drive arm 917 through the base plate shaft, the sub feeding drive arm and the like.

The main feed gear 901 and the sub feed gear 902 of the stitch feed adjusting portion 900 can feed a suitable amount of a cloth pressed to a needle plate (referring to FIG. 1) by a pressure foot 1050 fixed to a front end of a push rod 1051 slidably mounted on the machine casing 1.

Figure 4:
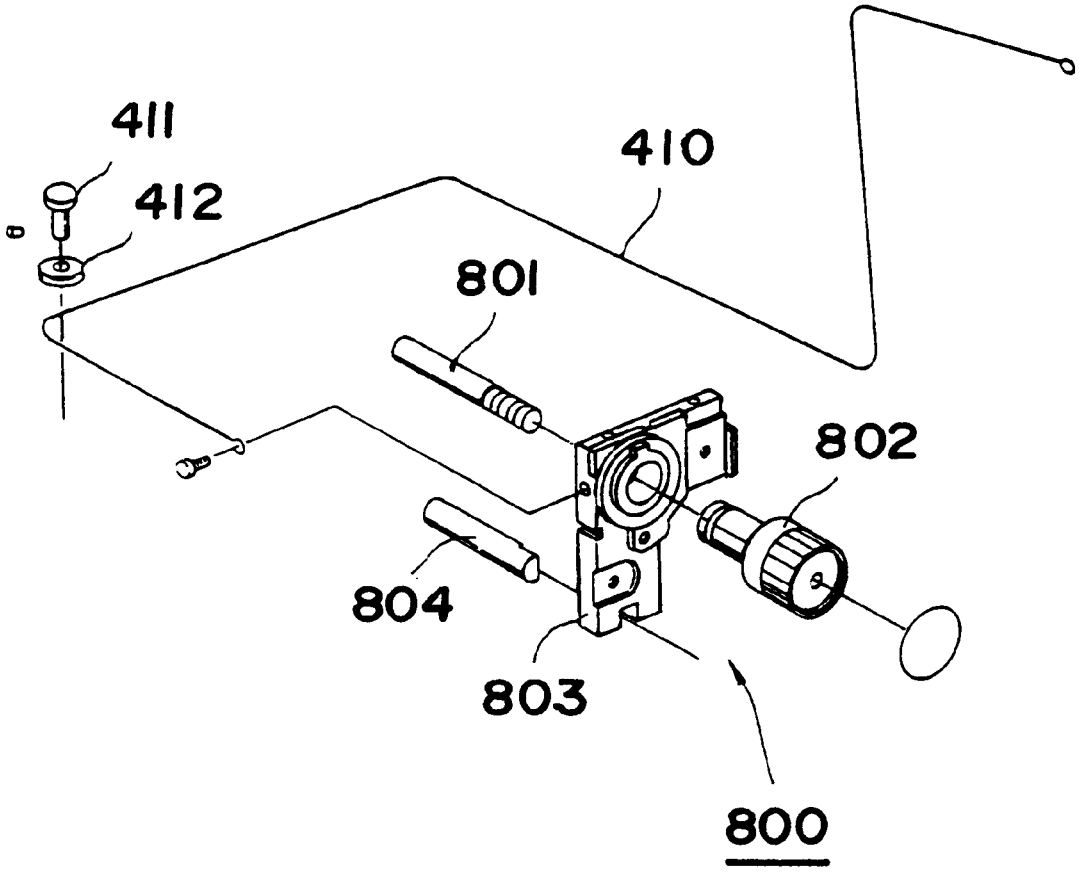
FIG. 4 is an exploded perspective view which shows a mechanism for adjusting stitch width in the overlock sewing machine of FIG. 1.

The overlock sewing machine having two needles and four threads also has a stitch width adjusting mechanism 800 as shown in FIG. 4, for changing the width of a cloth cut (a knife cut width) made by a knife drive mechanism 36 for cutting an even edge on the cloth immediately before sewing. The stitch width adjusting mechanism 800 has a stitch width adjusting dial 802 screwed to a shaft 801 fixed to the machine casing 1 and a lower knife base plate 803 axially supported by the stitch width adjusting dial 802. The rotational motion of the lower knife base plate 803 is restricted by a rotation stop shaft 804 fixed to the machine casing 1.

Referring to FIG. 1, a stitch is formed on the cloth by the left needle 9A, the right needle 9B, the upper looper 27 and the lower looper 21 of a stitch forming device 100 for an overlock sewing machine as described above. A thread feeding mechanism is used for feeding each of threads to the left needle 9A, the right needle 9B, the upper looper 27 and the lower looper 21 of the stitch forming device 100.

Figure 5:
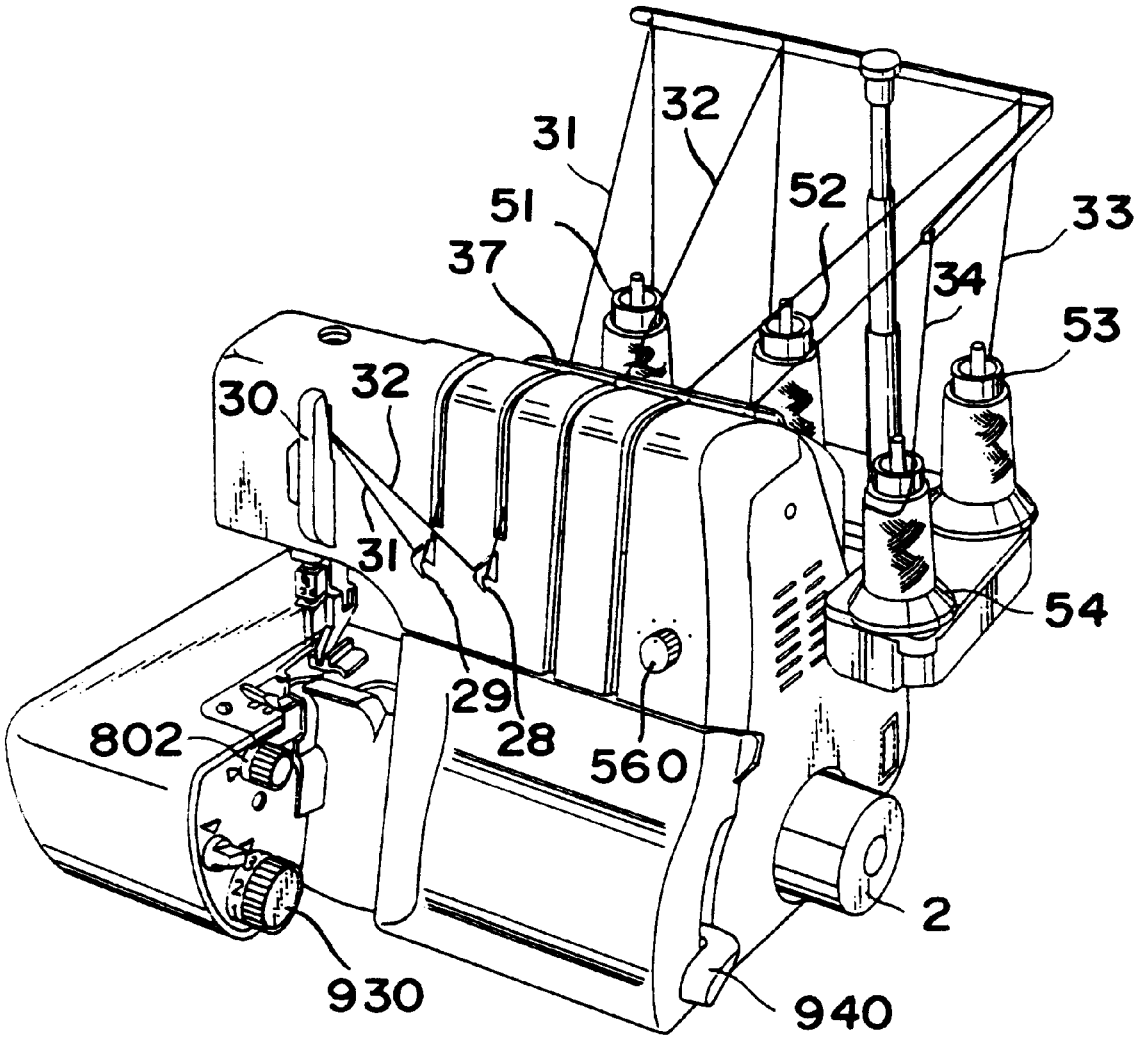
FIG. 5 is a perspective view which shows an overlock sewing machine incorporating a thread feeding apparatus in accordance with the present invention.

The thread feeding mechanism is provided with a left needle thread upstream gripper 40, a right needle thread upstream gripper 41, an upper looper thread upstream gripper 50 and a lower looper thread upstream gripper 60 (referring to FIGS. 1 and 6) which grip a left needle thread 31, a right needle thread 32, an upper looper thread 33 and a lower looper thread 34, respectively fed from bobbins 51, 52, 53 and 54, and which are closed by the stitch forming device 100 at the time of forming a stitch and are opened at the time of feeding a cloth, as shown in FIG. 5.

Referring to FIGS. 6, 7, 8*a* and 8*b*, left needle thread upstream gripper 40, the right needle thread upstream gripper 41, the upper looper thread upstream gripper 50 and the lower looper thread upstream gripper 60 are each provided with a pair of grip plates 44, compression spring receivers 45, compression springs 46, thrust receivers 47 and spring receivers 48 on upper gripper shafts 42 pivotally attached to five upstream gripper supporting plates 43, respectively fixed to a thread feeding unit base plate 501 fixed to the machine casing 1, as shown in FIGS. 1, 6, 7 and 8.

The pair of grip plates 44, compression spring receivers 45, compression springs 46, thrust receivers 47 and spring receivers 48 are respectively provided between the upstream gripper supporting plates 43 as a set. More specifically, the compression spring 46 is disposed between the compression spring receiver 45 and the spring receiver 48 axially arranged on the upstream gripper shaft 42. Further, the thrust receiver 47 is threaded on the upstream gripper shaft 42 between the pair of grip plate 44 and the compression spring receiver 45. The thrust receiver 47 is provided for the purpose of stopping the pair of grip plates 44 at a predetermined position through the compression spring receiver 45 in order to release the left needle thread 31, the right needle thread 32, the upper looper thread 33 and the lower looper thread 34 at the time of feeding a cloth.

Further, the thread feeding mechanism is provided with a left needle thread downstream gripper 70, a right needle thread downstream gripper 71, an upper looper thread downstream gripper 80 and a lower looper thread downstream gripper 90 which grip the left needle thread 31, the right needle thread 32, the upper looper thread 33 and the lower looper thread 34, respectively introduced from the left needle thread upstream gripper 40, the right needle thread upstream gripper 41, the upper looper thread upstream gripper 50 and the lower looper thread upstream gripper 60 and which are opened at the time of forming a stitch so that the left needle thread 31, the right needle thread 32, the upper looper thread 33 and the lower looper thread 34 are pulled out by the stitch forming device 100 and are closed at the time of feeding a cloth.

Figure 6:
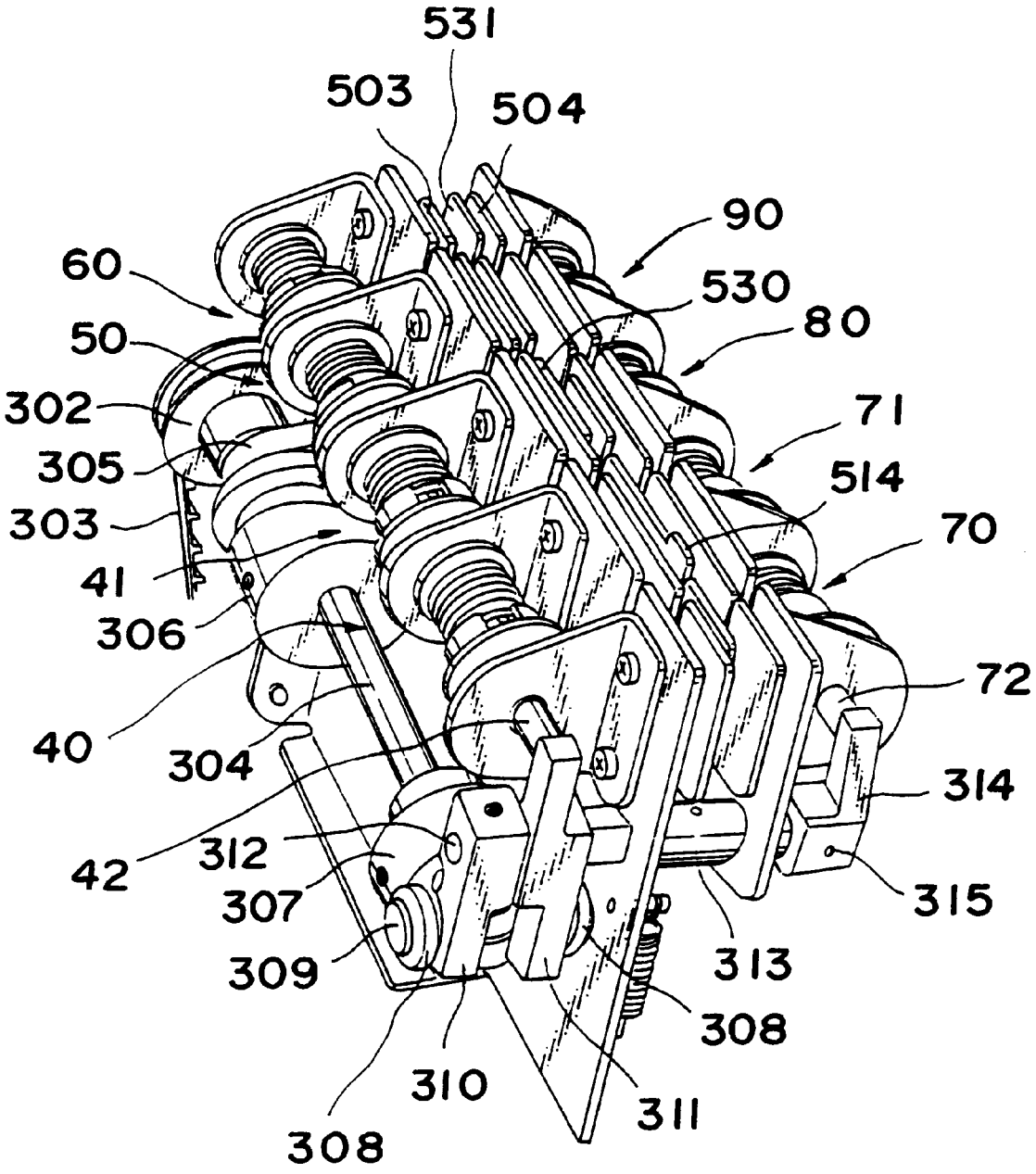
FIG. 6 is a perspective view which shows a thread feeding apparatus for an overlock sewing machine in accordance with the present invention.

The left needle thread downstream gripper 70, the right needle thread downstream gripper 71, the upper looper thread downstream gripper 80 and the lower looper thread downstream gripper 90 are mounted on a thread feeding unit front plate 502 which is fixed to the thread feeding unit base plate 501 and therethrough fixed to the machine casing 1 by connecting screws 510. Connecting screws 510 extend respectively through a shifter supporting shaft 511 and a spacer 512, a reciprocator supporting shaft 508A and a spacer 509A, a reciprocator supporting shaft 508B and a spacer 509B, and a shifter supporting shaft 521 and a spacer 522, as shown in FIGS. 1, 6, 8, 9 and 10. The left needle thread downstream gripper 70, the right needle thread downstream gripper 71, the upper looper thread downstream gripper 80 and the lower looper thread downstream gripper 90 are mounted on downstream grip shaft 72 which is rotatably supported by five downstream gripper supporting plates 73 fixed to the thread feeding unit front plate 502. Pairs of grip plates 44, compression spring receivers 45, compression springs 46, thrust receivers 47 and spring receivers 48 are mounted on the downstream grip shaft 72 as shown in FIG. 6.

The pairs of grip plates 44, compression spring receivers 45, compression springs 46, thrust receivers 47 and spring receivers 48 are provided between the downstream gripper supporting plates 73 as a set. More specifically, the compression spring 46 is disposed between the compression spring receiver 45 and the spring receiver 48 axially mounted on the downstream grip shaft 72. Further, the thrust receiver 47 is screwed on the downstream gripper 72 between the pair of grip plates 44 and the compression spring receiver 45. The thrust receiver 47 is provided for the purpose of stopping the pair of grip plates 44 at a predetermined position through the compression spring receiver 45 in order to release the left needle thread 31, the right needle thread 32, the upper looper thread 33 and the lower looper thread 34 at the time of forming a stitch.

Figure 7:
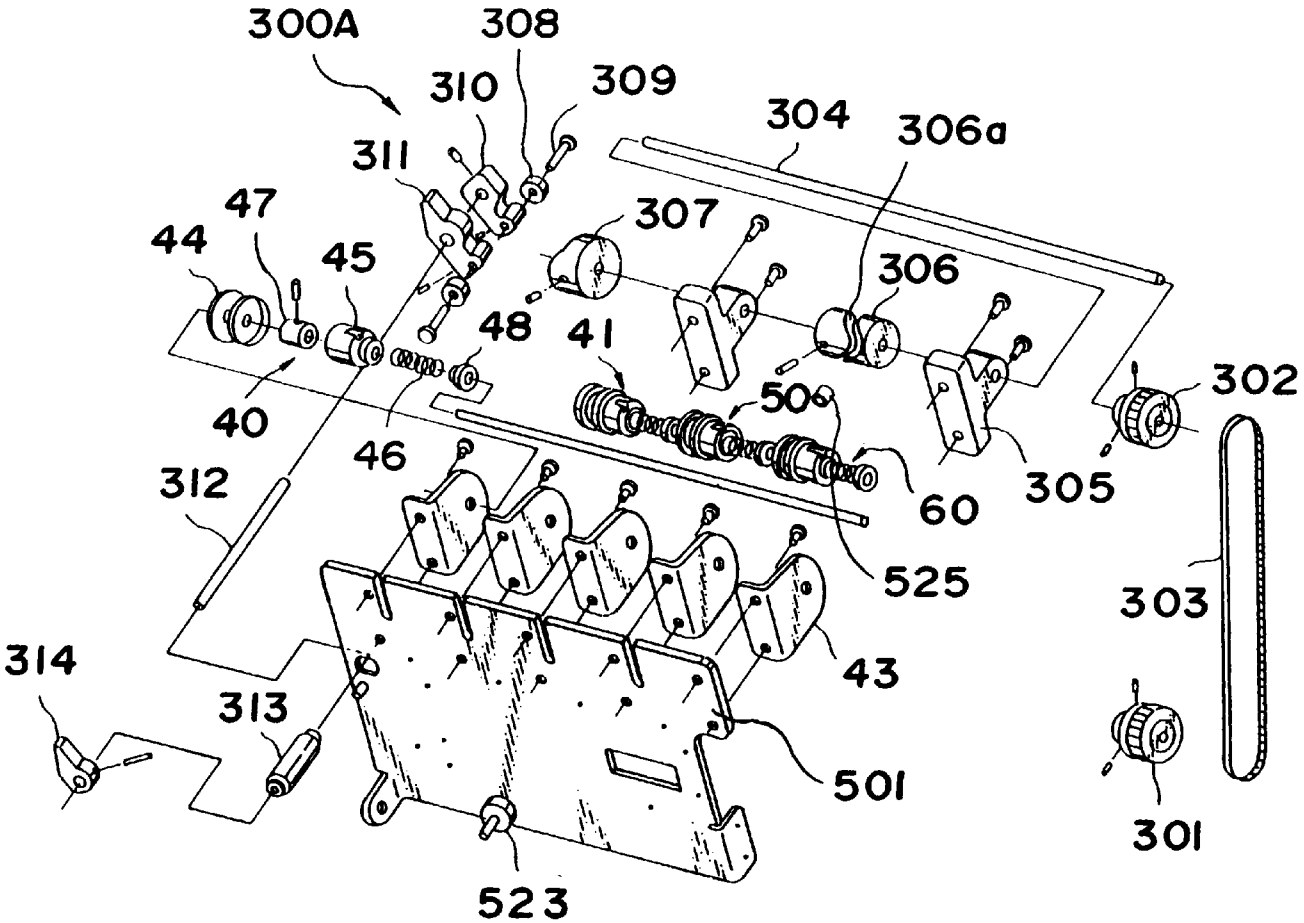
FIG. 7 is an exploded perspective view which shows an upstream gripper and a driving mechanism for thread feeding in the thread feeding apparatus for an overlock sewing machine in accordance with the present invention.
Figure 8A:
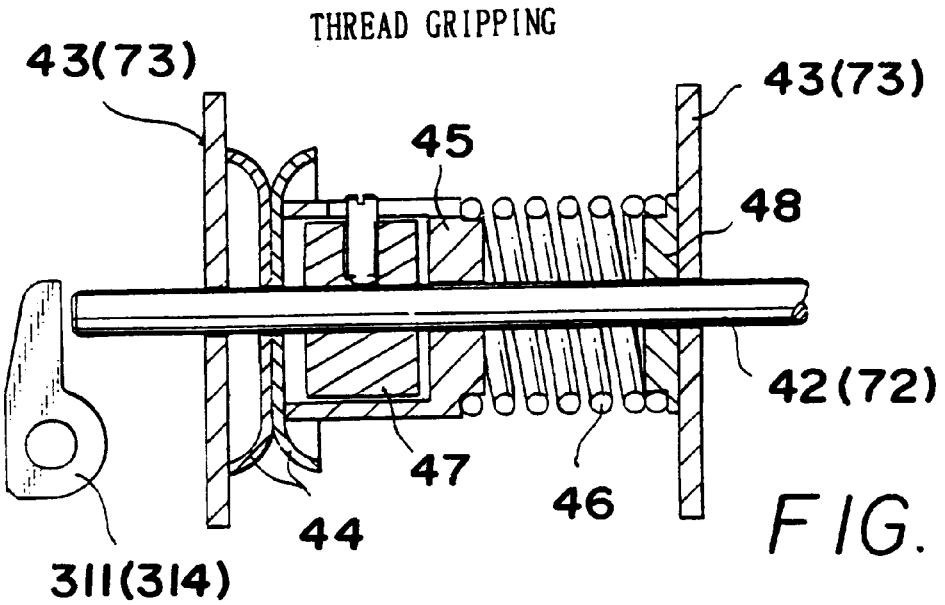
FIGS. 8(*a*) and 8(*b*) are cross sectional views which show an upstream gripper and a downstream gripper of a thread feeding apparatus for an overlock sewing machine in accordance with the present invention, in which FIG. 8(*a*) shows an open state and FIG. 8(*b*) shows a closed state.
Figure 8B:
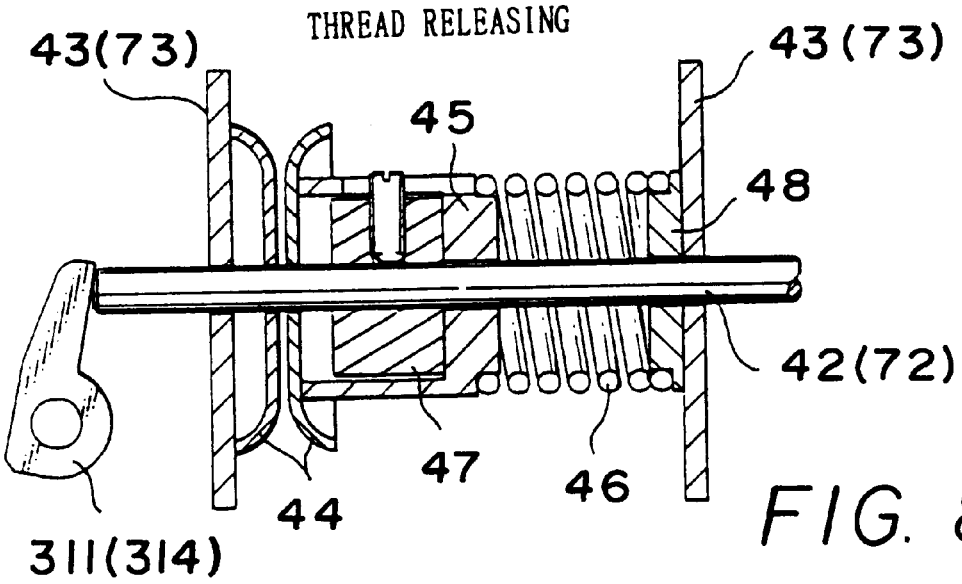
Figure 9:
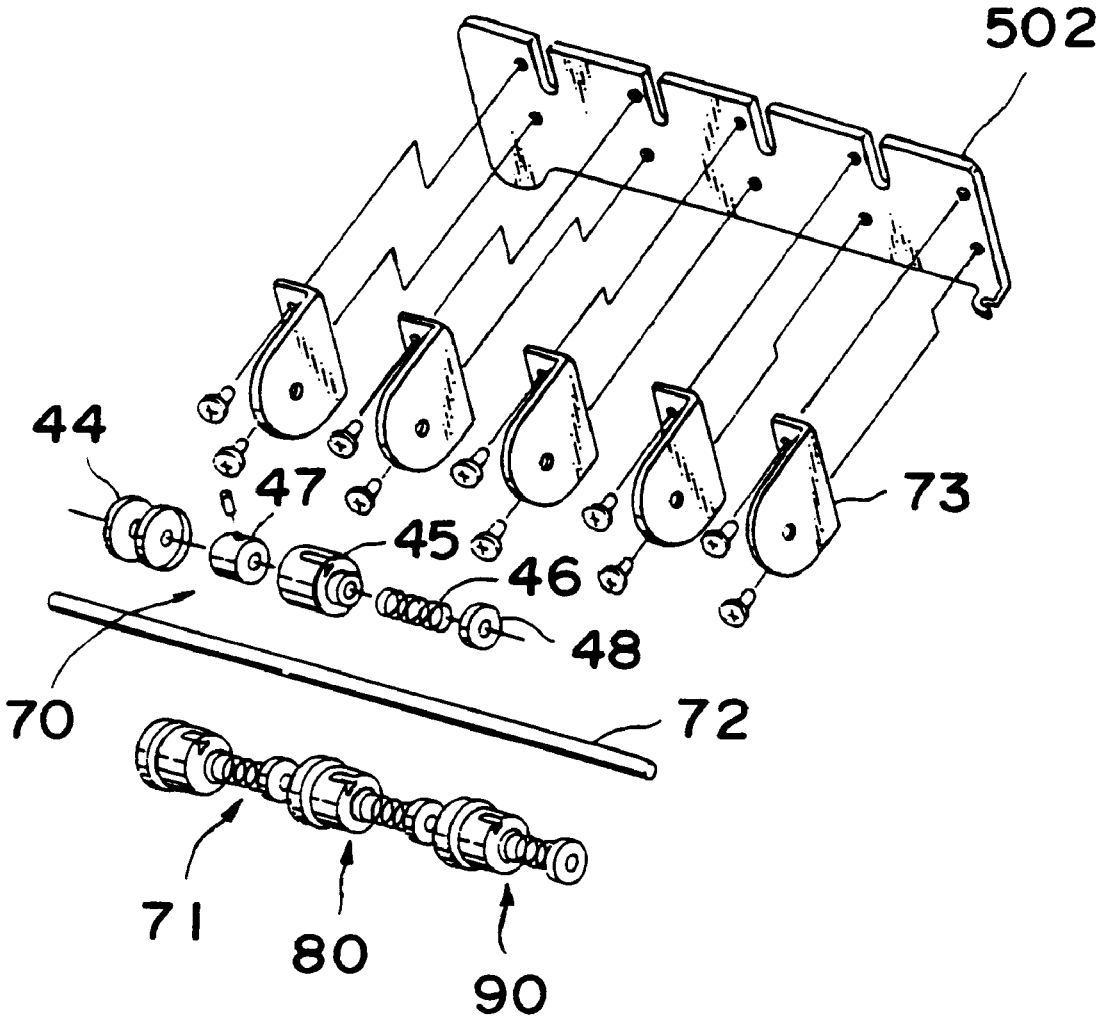
FIG. 9 is an exploded perspective view which shows a downstream gripper of a thread feeding apparatus for an overlock sewing machine in accordance with the present invention.

The thread feeding device is provided with a thread feed drive mechanism 300 which closes the left needle thread upstream gripper 40, the right needle thread upstream gripper 41, the upper looper thread upstream gripper 50 and the lower looper thread upstream gripper 60 at the time of forming a stitch and opens same at the time of feeding a cloth, as shown in FIGS. 6, 7 and 9. The thread feed drive mechanism 300 transmits rotation of a thread feed drive pulley 301, which is fixed to the drive shaft 3, to the left needle thread upstream gripper 40, the right needle thread upstream gripper 41, the upper looper thread upstream gripper 50, the lower looper thread upstream gripper 60, the left needle thread downstream gripper 70, the right needle thread downstream gripper 71, the upper looper thread downstream gripper 80 and the lower looper thread downstream gripper 90, through a timing belt 303 (referring to FIG. 1).

The thread feed drive mechanism 300 includes a thread feed drive shaft pulley 302 driven by the timing belt 303, which in turn is driven by the thread feed drive pulley 301. Pulley 301 is fixed to an end of a thread feed drive shaft 304 which in turn is axially supported by a thread feed drive shaft receiver 305 fixed to the thread feed unit base plate 501. Thread feed drive mechanism 300 further includes a thread grip drive cam 307 (a front cam) which is fixed to the other end of the thread feed drive shaft 304. The front cam of the thread grip drive cam 307 operates to close the left needle thread upstream gripper 40, the right needle thread upstream gripper 41, the upper looper thread upstream gripper 50 and the lower looper thread upstream gripper 60 at the time of forming a stitch, so as to grip the left needle thread 31, the right needle thread 32, the upper looper thread 33 and the lower looper thread 34 and to open same at the time of feeding cloth in a synchronous manner with the stitch forming mechanism 100.

In order to respectively close and open the left needle thread upstream gripper 40, the right needle thread upstream gripper 41, the upper looper thread upstream gripper 50, the lower looper thread upstream gripper 60, the left needle thread downstream gripper 70, the right needle thread downstream gripper 71, the upper looper downstream gripper 80, the lower looper thread downstream gripper 90, the thread feed drive mechanism 300 has a gripper open and close drive mechanism 300A, shown in FIG. 7 (also see FIG. 6). The gripper open and close drive mechanism 300A is provided with a downstream gripper drive arm 310 and an upstream gripper open arm 311 to which cam followers 308, operated by the front cam of the thread grip drive cam 307, are axially attached by a shaft 309. The downstream gripper drive arm 310 and the upstream gripper open arm 311 are fixed to an end of a gripper drive shaft 312 which is axially supported by a gripper drive shaft receiver 313 which, in turn, is held between the thread feed unit base plate 501 and the thread feed unit front plate 502. A downstream gripper open arm 314 is fixed to the other end of the gripper drive shaft 312.

In the gripper open and close drive mechanism 300A, the upstream gripper open arm 311 can lift up an end of the upstream grip shaft 42 by rotation of the thread grip drive cam 307 and the downstream gripper open arm 314 can lift up an end of the downstream grip shaft 72 through the downstream gripper drive arm 310, respectively.

Figure 10:
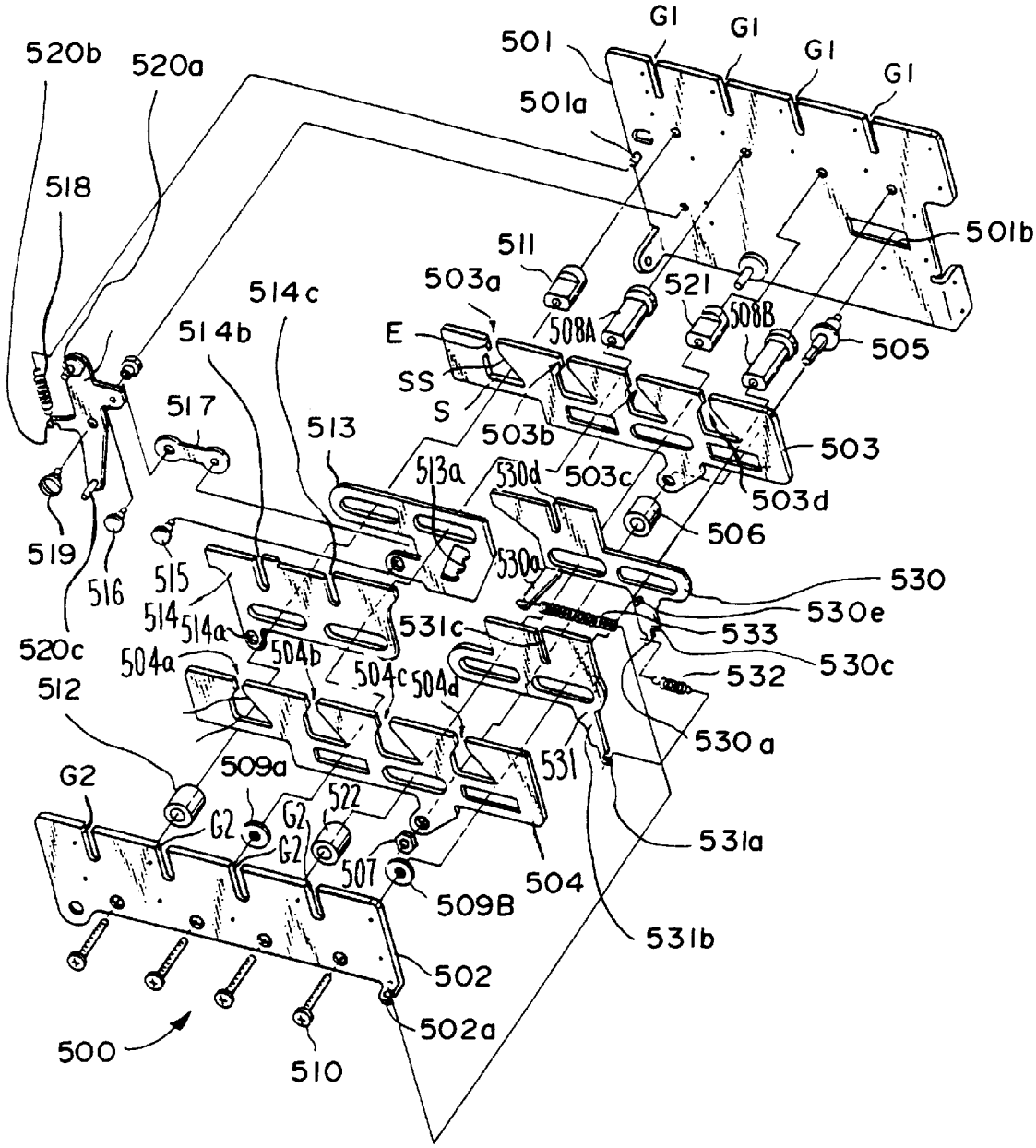
FIG. 10 is an exploded perspective view which shows a reciprocator and a shifter of a thread feeding apparatus for an overlock sewing machine in accordance with the present invention.

The thread feeding device is driven in a synchronous manner with the left needle 9A, the right needle 9B, the upper looper 27 and the lower looper 21, respectively, as shown in FIG. 10, and is provided with a pair of reciprocators 503 and 504 which shift to feed quantities of the left needle thread 31, the right needle thread 32, the upper looper thread 33 and the lower looper thread 34, in amounts for forming a stitch, to the thread paths extending from the left needle thread upstream gripper 40, the right needle thread upstream gripper 41, the upper looper thread upstream gripper 50 and the lower looper thread upstream gripper 60, which are open at the time of feeding a cloth, respectively to the left needle thread downstream gripper 70, the right needle thread downstream gripper 71, the upper looper thread downstream gripper 80 and the lower looper downstream gripper 90 which are then closed. The reciprocators 503 and 504 release the left needle thread 31, the right needle thread 32, the upper looper thread 33 and the lower looper thread 34 at the time of a stitch forming.

The pair of reciprocators 503 and 504 is provided with left needle thread reciprocators 503*a* and 504*a,* right needle thread reciprocators 503*b* and 504*b,* upper looper thread reciprocators 503*c* and 504*c* and lower looper reciprocators 503*d* and 504*d,* respectively corresponding to the left needle thread 31, the right needle thread 32, the upper looper thread 33 and the lower looper thread 34. The left needle thread reciprocators 503*a* and 504*a,* the right needle thread reciprocators 503*b* and 504*b,* the upper looper thread reciprocators 503*c* and 504*c* and the lower looper reciprocators 503*d* and 504*d* include inclined sides SS which respectively guide the left needle thread 31, the right needle thread 32, the upper looper thread 33 and the lower looper thread 34, respectively introduced through inlet ports E, onto a thread path point S aligned with a pair of thread guide slots G1 and G2, respectively formed in the thread feed unit base plate 501 and the thread feed unit front plate 502.

As seen in FIG. 6, the pair of reciprocators 503 and 504 are disposed between the thread feed unit base plate 501 and the thread feed unit front plate 502 which are separately disposed between the left needle thread upstream gripper 40, the right needle thread upstream gripper 41, the upper looper thread upstream gripper 50 and the lower looper thread upstream gripper 60, and the left needle thread downstream gripper 70, the right needle thread downstream gripper 71, the upper looper thread downstream gripper 80 and the lower looper thread downstream gripper 90, respectively in a thread feeding direction.

Figure 11:
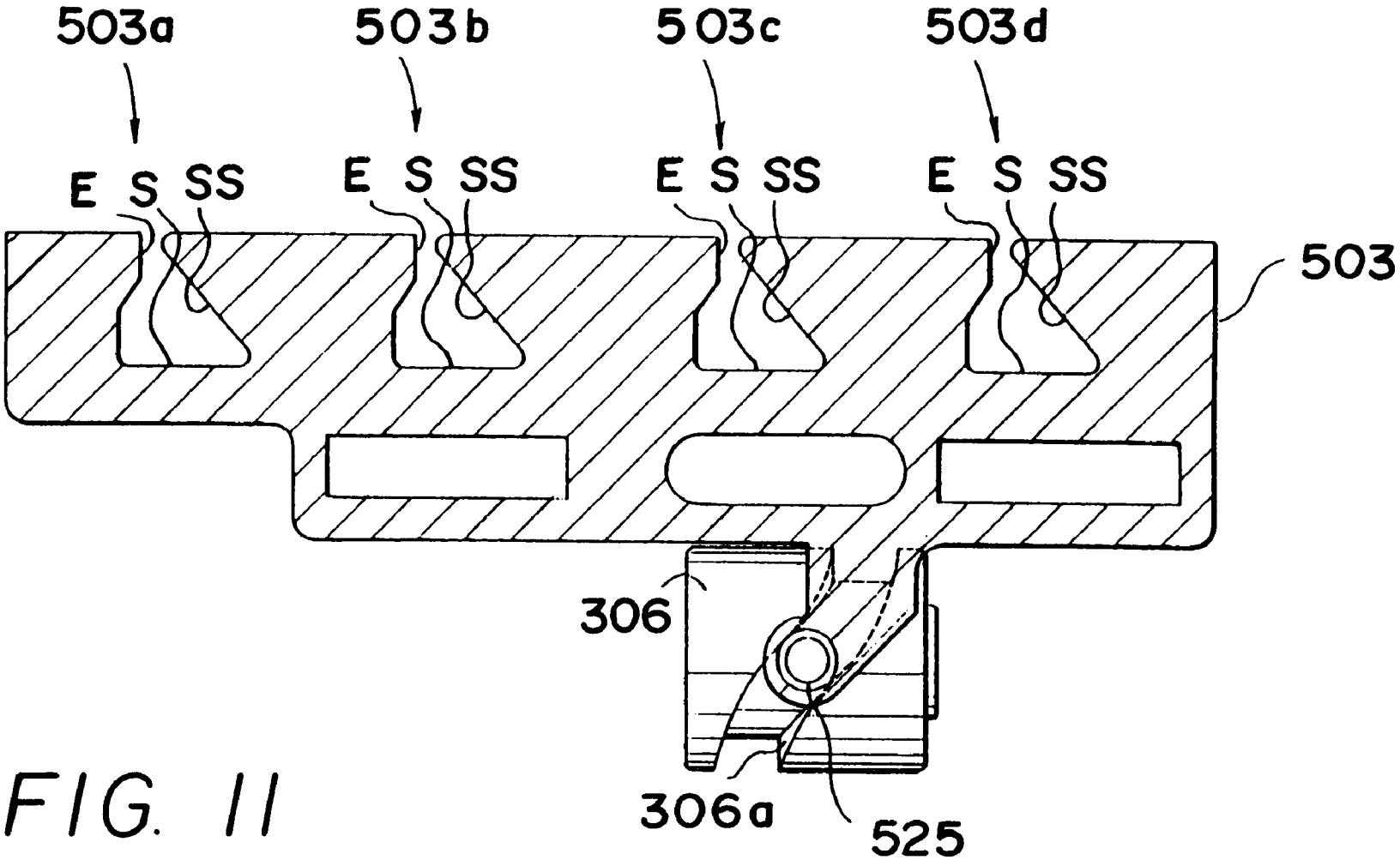
FIG. 11 is a view, partially in cross-section, which shows a reciprocator of a thread feeding apparatus for an overlock sewing machine in accordance with the present invention and a reciprocator driving cam.

Referring to FIGS. 7, 10 and 11, the pair of reciprocators 503 and 504 are connected by a male screw portion formed on one end of a reciprocator drive shaft 505 and a nut 507 through a spacer 506 (FIG. 10). The pair of connected reciprocators 503 and 504 are reciprocally supported by the reciprocator supporting shafts 508A and 508B fixed between the thread feed unit base plate 501 and the thread feed unit front plate 502. Further, a cam follower 525 is fixed to the other end of the reciprocator drive shaft 505, and the cam follower 525 projects from a hole 501*b* formed in the thread feed unit base plate 501 so as to engage a groove 306*a* of a reciprocator drive cam 306 fixedly attached to the thread feed drive shaft 304. The groove 306*a* of the reciprocator drive cam 306 reciprocates the pair of reciprocators 503 and 504 by driving the reciprocator drive shaft 505 with rotation of the thread feed drive shaft 304.

Further, the thread feeding device has, as shown in FIG. 10, a needle thread shifter 514, an upper looper thread shifter 530 and a lower looper thread shifter 531 which respectively adjust the extent of shift of the thread paths in a direction perpendicular to a thread feeding direction by the pair of reciprocators 503 and 504, to correspond to each of the thread quantities necessary for one stitch, which shift extent is changed in response to change of a stitch width and a stitch length.

As is further shown in FIG. 10, the needle thread shifter 514, the upper looper thread shifter 530 and the lower looper thread shifter 531 are disposed between the pair of reciprocators 503 and 504. The needle thread shifter 514 is provided with thread grooves 514*b* and 514*c* for receiving the left needle thread 31 and the right needle thread 32 and is supported by the one reciprocator supporting shaft 508A and the shifter supporting shaft 511, fixed between the thread feed unit base plate 501 and the thread feed unit front plate 502, for movement in a direction perpendicular to a thread feeding direction. Further, a hole 514*a* is formed on an end of the needle thread shifter 514 and receives a needle thread shifter drive shaft 520*a* provided on an end of a stitch feed adjust and shift lever 520. Shift lever 520 is pivotally attached to the thread feed unit base plate 501 by a stepped screw 519. The stitch feed adjust and shift lever 520 is provided with a projecting spring hook 520*b,* and a tension spring 518 is provided between the spring hook 520*b* and the projecting pin 501*a* provided on the thread feed unit base plate 501. An end of a connecting link 517 is axially attached to the stitch feed adjust and shift lever 520 by a stepped pin 516 and the other end of the connecting link 517 is axially attached to a shift adjusting plate 513 by a stepped pin 515.

The shift adjusting plate 513 is supported by the shifter supporting shaft 511 and by the reciprocator supporting shaft 508A in a manner allowing movement in a direction perpendicular to the thread feeding direction.

Accordingly, since the stitch feed adjust and shift lever 520 is always biased toward rotation in a clockwise direction as viewed by a sewing operator, the needle thread shifter 514 and the shift adjusting plate 513 are biased in a horizontal direction to the right.

The upper looper thread shifter 530 and the lower looper thread shifter 531 are respectively provided with thread grooves 530*d* and 531*c* for receiving the upper looper thread 33 and the lower looper thread 34 and are supported by the other reciprocator supporting shaft 508B and the shifter supporting shaft 521 fixed between the thread feed unit base plate 501 and the thread feed unit front plate 502 in a manner allowing movement in a direction perpendicular to the thread feeding direction. A first projecting spring hook 530*a* is provided at one end of the upper looper thread shifter 530, and a tension spring 533 is provided between the first spring hook 530*a* and a projecting spring hook provided on an end of the thread feed unit front plate 502. Accordingly, the upper looper thread shifter 530 is biased rightward in a horizontal direction as seen from the thread feed unit front plate 502. A second projecting spring hook 530*b* is provided at the other end of the upper looper thread shifter 530, and a tension spring 532 is provided between the second spring hook 530*b* and a projecting spring hook 531*a* provided on an end of the lower looper thread shifter 531. Accordingly, the lower looper thread shifter 531 is biased leftward in the horizontal direction as seen from the thread feed unit front plate 502.

The thread feeding apparatus is provided with a stitch changeover means 500 which displaces the upper looper thread shifter 530 and the lower looper thread shifter 531 in such a manner as to substantially equalize the shift quantity of the upper looper thread 33 necessary for a stitch and the shift quantity of the lower looper thread 34 necessary for a stitch when sewing a narrow hem, and to increase the shift quantity of the upper looper thread 33 necessary for a stitch and decrease the shift quantity of the lower looper thread 34 when sewing a rolled hem (FIG. 1).

Figure 12:
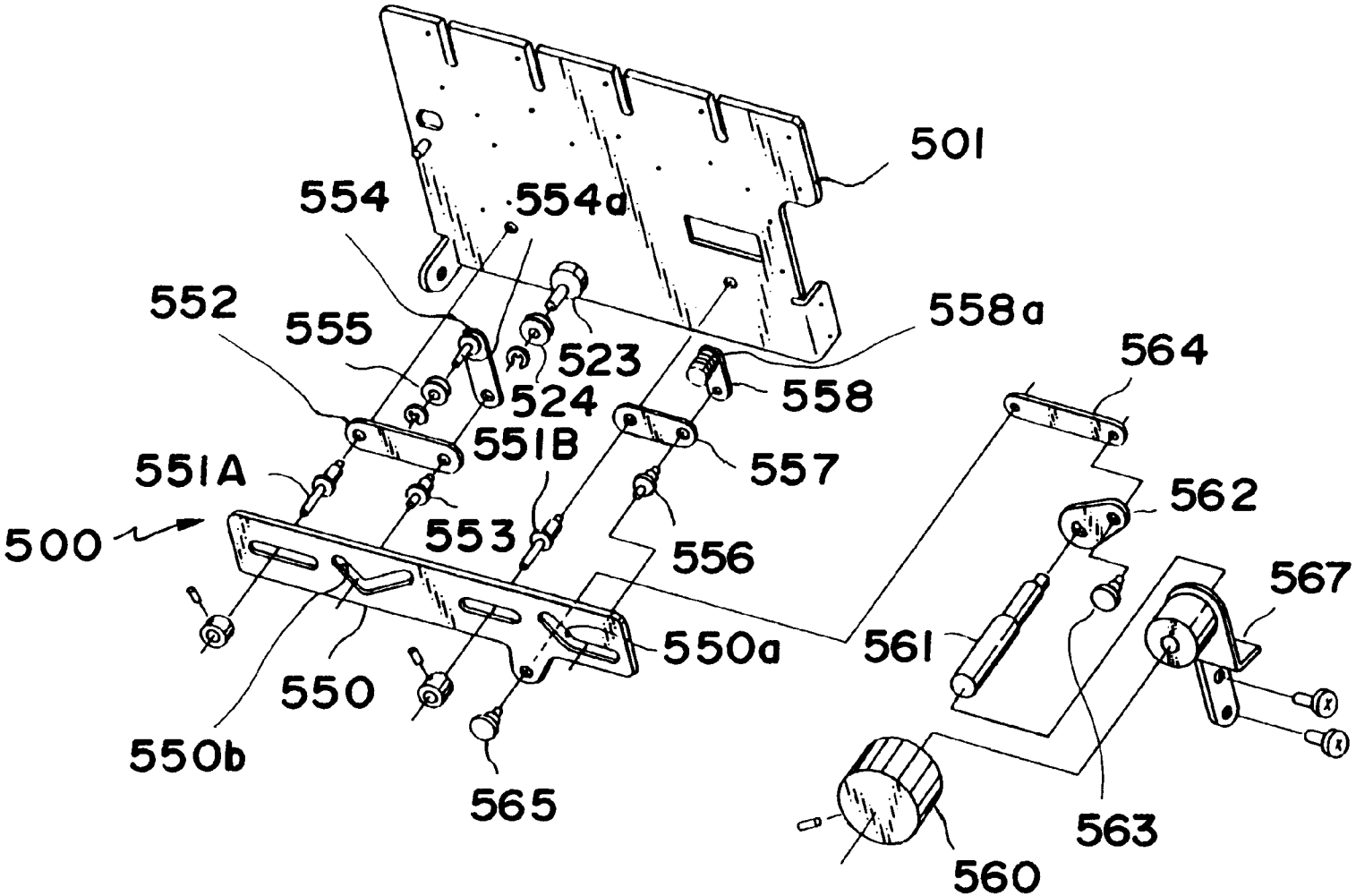
FIG. 12 is an exploded perspective view which shows a changeover means of a thread feeding apparatus for an overlock machine in accordance with the present invention.

Referring to FIG. 12, the stitch changeover means 500 can change the sewing mode between narrow hem sewing, rolled hem sewing, single needle overlock sewing and double needle overlock sewing, responsive to rotation of a stitch selecting dial 560 so as to horizontally move stitch changeover cam plate 550. The stitch changeover cam plate 550 is provided with a narrow hem changeover cam 550*a* for changing between the narrow hem sewing, rolled hem sewing and a looper thread adjusting cam 550*b* for changing between single needle overlock sewing and double needle overlock sewing, and is supported on two stitch changeover cam plate supporting shafts 551A and 551B, fixed to the thread feed unit base plate 501, in such a manner as to allow horizontal movement.

An end of a looper thread adjusting arm 552 is axially attached to the stitch changeover cam plate supporting shaft 551A and the other end of the looper adjusting arm 552 is axially attached to a looper thread adjusting cam follower 553 which is engaged within the looper thread adjusting cam 550*b* of the stitch changeover cam plate 550. Further, an end of a looper thread adjusting link 554 is axially attached to the looper thread adjusting cam follower 553, and a pulley shaft 554*a* is provided on the other end of the looper thread adjusting link 554 and is engaged within a cam groove 513*a* (referring to FIG. 10) provided on the shift adjust plate 513.

An end of a narrow hem changeover arm 557 is axially attached to the stitch changeover cam plate supporting shaft 551B and the other end of the narrow hem changeover arm 557 is axially attached to a narrow hem cam follower 556 which is engaged within the looper thread adjusting cam 550*a* of the stitch changeover cam plate 550. Further, an end of a narrow hem changeover link 558 is axially attached to the narrow hem cam follower 556, and a narrow hem changeover piece 558*a,* provided on the other end of the narrow hem changeover link 558, is engaged with end surface cams 530*c* and 531*b* (referring to FIG. 10), respectively formed on the upper looper thread shifter 530 and the lower looper thread shifter 531. The end surface cams 530*c* and 531*b* are structured such that when the narrow hem changeover piece 558*a* ascends, an inlet port 530*d* of the upper looper thread shifter 530 and an inlet port of the lower looper thread shifter 531 (referring to FIG. 10) are spaced from each other.

The stitch selecting dial 560 is fixed to an end of a stitch selecting dial shaft 561 axially supported by a stitch selecting dial support plate 567 fixed to the machine casing 1. The other end of the stitch selecting dial shaft 561 is fixed to a stitch selecting arm 562. A front end of the stitch selecting arm 562 is axially attached to an end of a connecting link 564 and the other end of the connecting link 564 is axially attached to an end of the stitch changeover cam plate 550 by a pin 565.

The thread feeding apparatus having the above structure includes the thread tension adjusting means 400 shown in FIGS. 4, 10, 13 and 14 for driving the upper looper thread shifter 530 and the lower looper thread shifter 531, together in an interlocked manner, in correspondence to the thread quantity necessary for a stitch, which quantity changes in response to operation of the stitch width adjust dial 802 of the stitch width adjust mechanism 800 (referring to FIG. 1). The thread tension adjusting means 400 connects the lower knife base plate 803 (FIG. 4) of the stitch width adjust mechanism 800 to a wire hook 530*e,* which projects from the upper looper thread shifter 530, by means of a stitch width adjust and interlock wire 410. Further, a wire hook 421*a* (referring to FIG. 3), projecting from the stitch feed adjusting arm 421 fixed to the adjust arm 934 of the stitch feed adjusting portion 900, is connected to a wire hook 520*c* (FIG. 10) of the stitch feed adjusting shift lever 520 by a stitch feed adjust and interlock wire 420.

Figure 13:
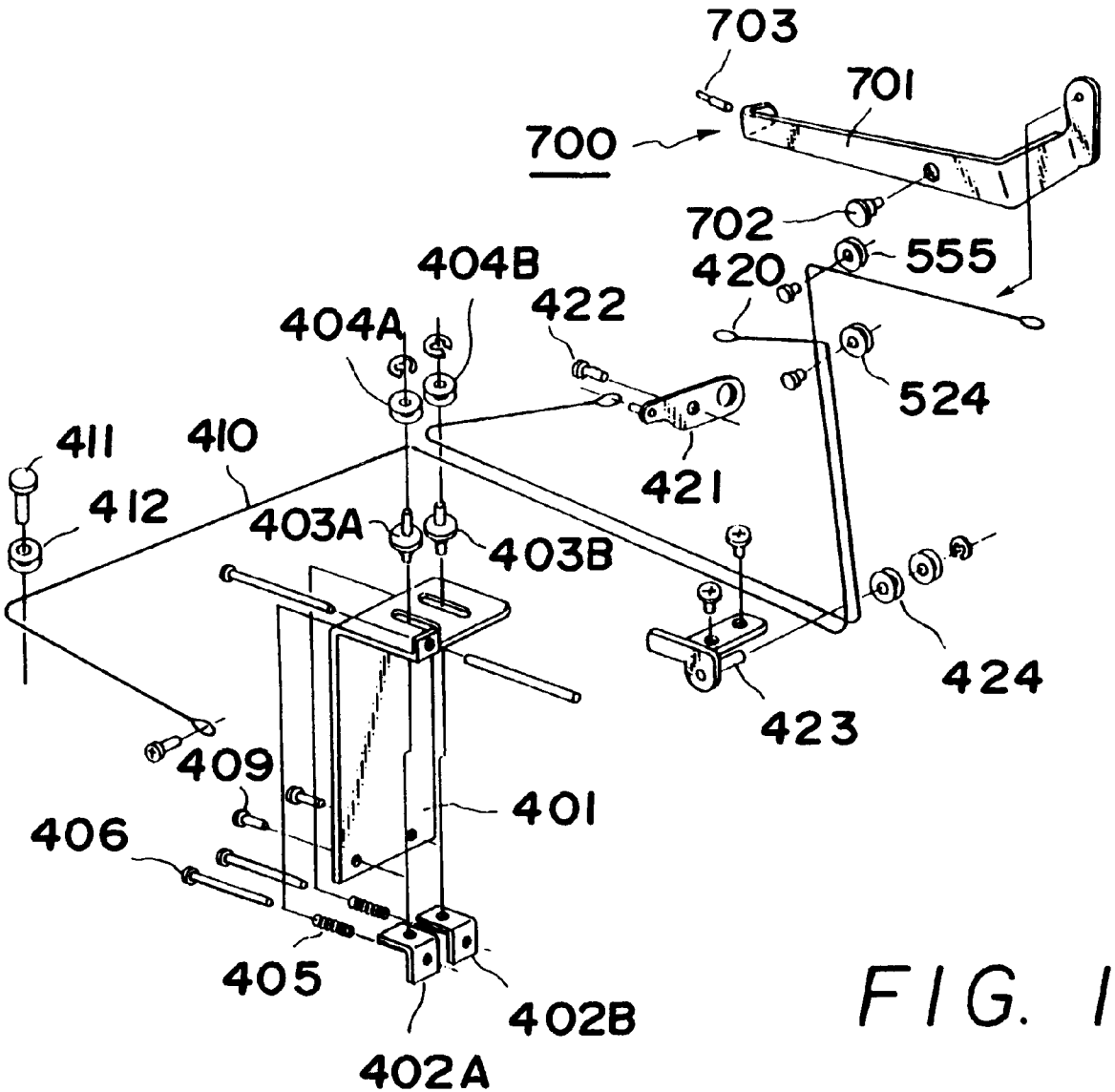
FIG. 13 is an exploded perspective view which shows an adjustment means for slightly adjusting thread tension in the thread feeding apparatus for an overlock sewing machine in accordance with the present invention.
Figure 14:
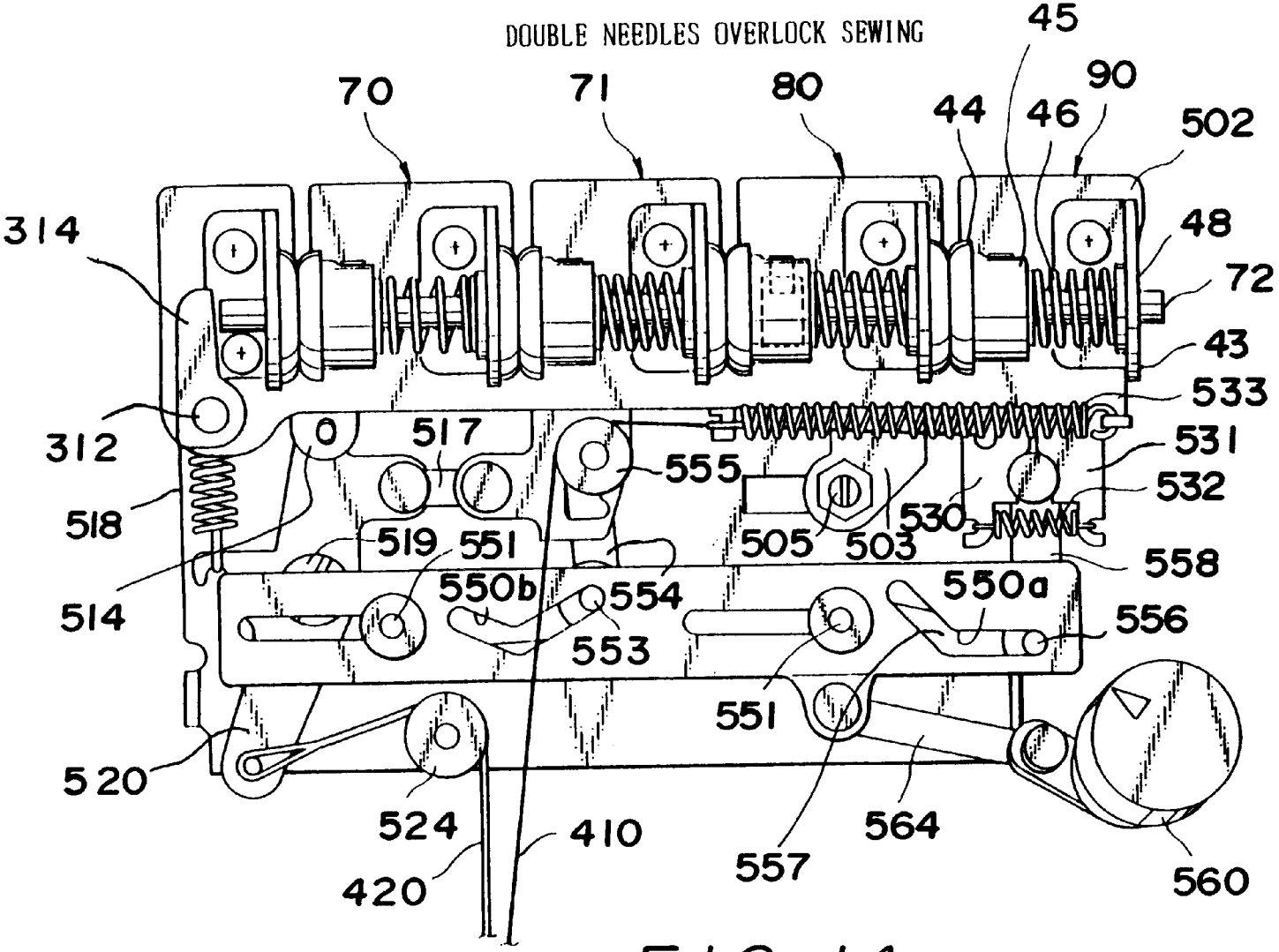
FIG. 14 is an explanatory view which shows positions of a needle thread shifter, an upper looper thread shifter and a lower looper thread shifter in the case where double needle overlock sewing is selected by the stitch changeover means of a thread feeding apparatus for an overlock sewing machine in accordance with the present invention.

As seen in FIGS. 13 and 14, the stitch width adjust and interlock wire 410 is wound around a pulley 412, a pulley 404A, a pulley 424A and a pulley 555 so as to be introduced to the upper looper thread shifter 530 from the lower knife base plate 803. The stitch feed adjust and interlock wire 420 is wound around a pulley 404B, a pulley 424B and a pulley 524 so as to be introduced to the stitch feed adjust and shift lever 520 from the stitch feed adjust arm 421. The pulley 412 is rotatably fixed to the machine casing 1 at a position close to the stitch width adjust mechanism 800 by a shaft 411, and the pulleys 424A and 424B are rotatably fixed to a shaft projecting from a intermediate pulley plate 423 fixed near the center of the machine casing 1. The pulleys 404A and 404B are rotatably fixed to adjusting pulley shafts 403A and 403B, and the adjusting pulley shafts 403A and 403B extend through respective oval holes formed in a thread tension adjusting plate 401, which is fixed to the machine casing 1 at a position close to the stitch feed adjust mechanism 900, and into mounting seats of stitch width adjusting plates 402A and 402B. The stitch width adjusting plates 402A and 402B are respectively mounted on the thread tension adjust plate 401 by stitch width adjusting screws 406 through compression springs 405 to bias the stitch width adjusting plates 402A and 402B away from the thread tension adjusting plate 401. Accordingly, the fixed positions of the pulleys 404A and 404B can be changed by turning the stitch width adjusting screws 406.

As seen in FIG. 10, the pulley 555 is rotatably fixed to the pulley shaft 554*a* which projects from the looper thread adjust link 554 and the pulley 524 is rotatably fixed to the pulley shaft 523 which projects from the thread feed unit base plate 501.

Next, operation of the thread feeding apparatus having the above structure will be explained. In the explanation of the operation, directions in the description correspond to those as seen by an operator of the sewing machine.

At first, the left needle thread 31, the right needle thread 32, the upper looper thread 33 and the lower looper thread 34 are respectively pulled from their respective bobbins 51, 52, 53 and 54. The threads are then respectively inserted through a thread guide 37 (referring to FIG. 5) between the respective pair of grip plates 44 of the left needle thread upstream gripper 40, of the right needle thread upstream gripper 41, of the upper looper thread upstream gripper 50 and of the lower looper upstream gripper 60, and into the respective thread guides G1 of the thread feed unit base plate 501. From plate 501 the threads are led to the respective inlet ports E of the reciprocator 503, the respective slots 514*b* and 514*c* of the needle thread shifter 514, the inlet port 530*d* of the upper looper thread shifter 530, the inlet port 531*c* of the lower looper thread shifter 531, the respective inlet ports E of the reciprocator 504, and the respective thread guides G2 of the thread feed unit front plate 502. From plate 502 the threads are led, respectively, to the left needle thread downstream gripper 70, the right needle thread downstream gripper 71, the upper looper thread downstream gripper 80 and between the respective pairs of grip plates 44 of the lower looper thread downstream gripper 90. Then, the left needle thread 31 is inserted through the needle hole of the left needle 9A through the thread guide 28 and a needle thread balance 29. Likewise, the right needle thread 32 is passed through the needle hole of the left needle 9B and then through the thread guide 28 and a needle thread balance 29. The upper looper thread 33 and the lower looper thread 34 are passed through thread inlet ports of the upper looper 27 and the lower looper 21 and through a threader 35 which automatically guides the thread using a pressurized gas.

As mentioned above, when a sewing operation is started after completion of threading, the drive shaft 3 is rotated and the needle drive arm 6 is reciprocated in a swinging motion by the needle drive rod 5 pivotally attached to the needle drive eccentric cam 4 provided on the drive shaft 3, so that the right needle 9A and the left needle 9B undergo a reciprocating vertical motion. At that time, the thread feed drive pulley 301 rotates the thread grip drive cam 307 through the timing belt 303, the thread feed drive shaft pulley 302 and the thread feed drive shaft 304. During a rotation of the thread grip drive cam 307, the upstream gripper open arm 311 and the downstream gripper open arm 312 are alternately swung by a front cam of the thread grip drive cam 307. Accordingly, the upstream grip shaft 42 and the downstream grip shaft 72 reciprocate, alternately moved in the rightward direction by the upper gripper open arm 311 and the downward gripper open arm 312, thereby closing the left needle thread upstream gripper 40, the right needle thread upstream gripper 41, the upper looper thread upstream gripper 50 and the lower looper upstream gripper 60 when stitch forming and opening them when cloth feeding, and opening the left needle thread downstream gripper 70, the right needle thread downstream gripper 71, the upper looper thread downstream gripper 80 and the lower looper downstream gripper 90 when stitch forming and closing them when cloth feeding.

At the same time of opening and closing the grippers, the reciprocators 503 and 504 are driven by the cam follower 525, which is fitted into the groove 306*a* (FIG. 7) of the reciprocator drive cam 306 fixed to the drive shaft 3, with a reciprocating motion in a direction perpendicular the thread feeding direction for every one rotation of the drive shaft 3. At that time, the left needle thread 31, the right needle thread 32, the upper looper thread 33 and the lower looper thread 34 are respectively introduced to a point in the thread path S aligning with the respective thread guides G1 and G2, formed in the thread feed unit base plate 501 and the thread feed unit front plate 502, by the respective inclined surfaces SS of the reciprocators 503 and 504. Due to the reciprocating motion of the reciprocators 503 and 504, the left needle thread 31, the right needle thread 32, the upper looper thread 33 and the lower looper thread 34 are shifted and then released to provide a thread quantity for a stitch made by the stitch forming device 100.

Figure 18:
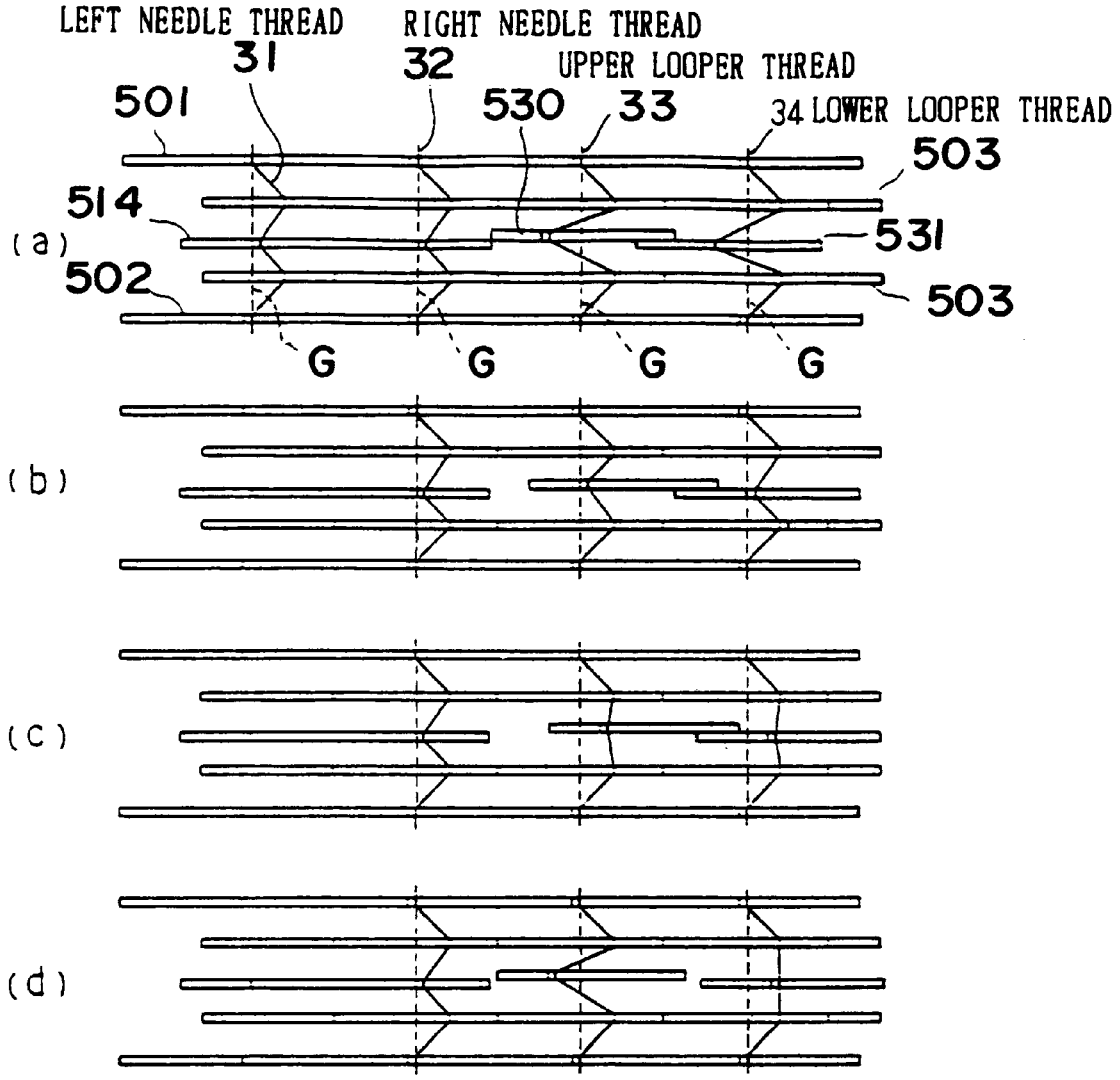
FIGS. 18(*a*), 18(*b*), 18(*c*) and 18(*d*) are views which show relative positioning of a thread feeding unit base plate, a reciprocator, a shifter and a thread feeding unit front plate in with a needle positioned in an upper dead center position, in which FIG. 18(*a*) shows relative positions in double needle overlock sewing, FIG. 18(*b*) shows relative positions in single needle overlock sewing, FIG. 18(*c*) shows relative positions in narrow hem sewing and FIG. 18(*d*) shows relative positions in rolled hem sewing.
Figure 19:
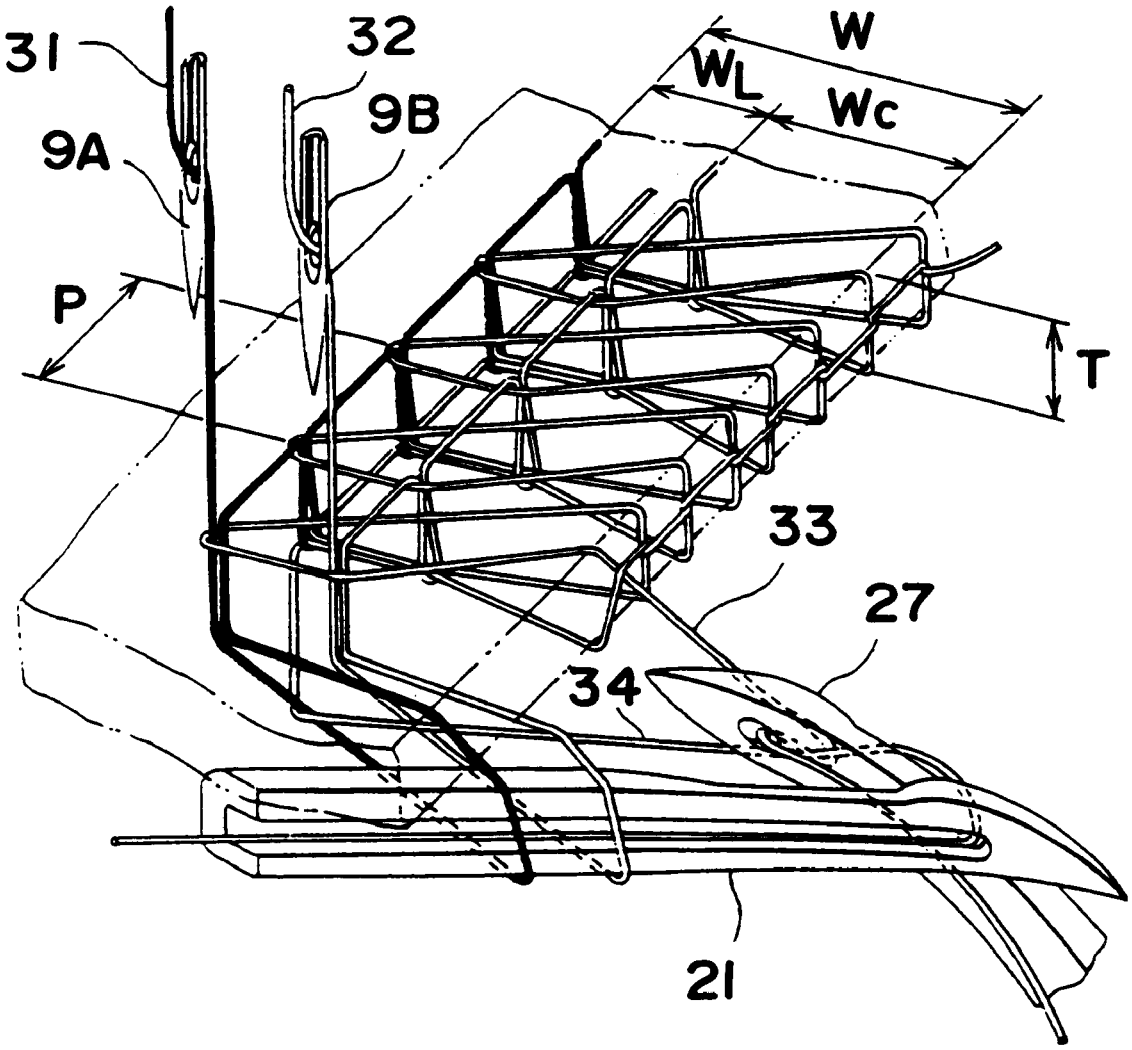
FIG. 19 is an explanatory view which shows stitch formation in double needle overlock sewing by the overlock sewing machine shown in FIG. 1.

To select between double needle overlock sewing, single needle overlock sewing, narrow hem sewing and rolled hem sewing, the mode can be changed by rotating the stitch selecting dial 560 of the stitch changeover means 500. For example, when double needle overlock sewing is selected by the stitch selecting dial 560, as shown in FIG. 14, since the stitch selecting cam 550 is positioned at a leftmost position, the looper thread adjust cam follower 553, engaging the looper thread adjust cam 550*b* of the stitch changeover cam plate 550, ascends along the looper thread adjust cam 550*b*. When the looper thread adjust cam follower 553 ascends, the pulley 555 ascends to the uppermost position of the cam groove 513*a* of the shift adjust plate 513 so that the stitch width adjust and interlock wire 410 is raised, thereby displacing the upper looper thread shifter 530, on which the stitch width adjust and interlock wire 410 is hooked, to the left. At this time, the lower looper thread shifter 531 is displaced leftward by the tensional force of the tension spring 532. Accordingly, the upper looper thread shifter 530 and the lower looper thread shifter 531, and the upper looper thread reciprocators 503*c* and 504*c* and the lower looper thread reciprocators 503*d* and 504*d* are respectively positioned so that shift quantity of the upper looper thread 33 and the lower looper thread 34 is greater when the left needle 9A and the right needle 9B are positioned at upper dead center, as shown in FIG. 18 (*a*). This is because, in double needle overlock sewing, as shown in FIG. 19, the stitch width W of the upper looper thread 33 and the lower looper thread 34 is increased by a needle width WL, as compared with the cases of single needle overlock sewing, narrow hem sewing and rolled hem sewing mentioned below.

Figure 15:
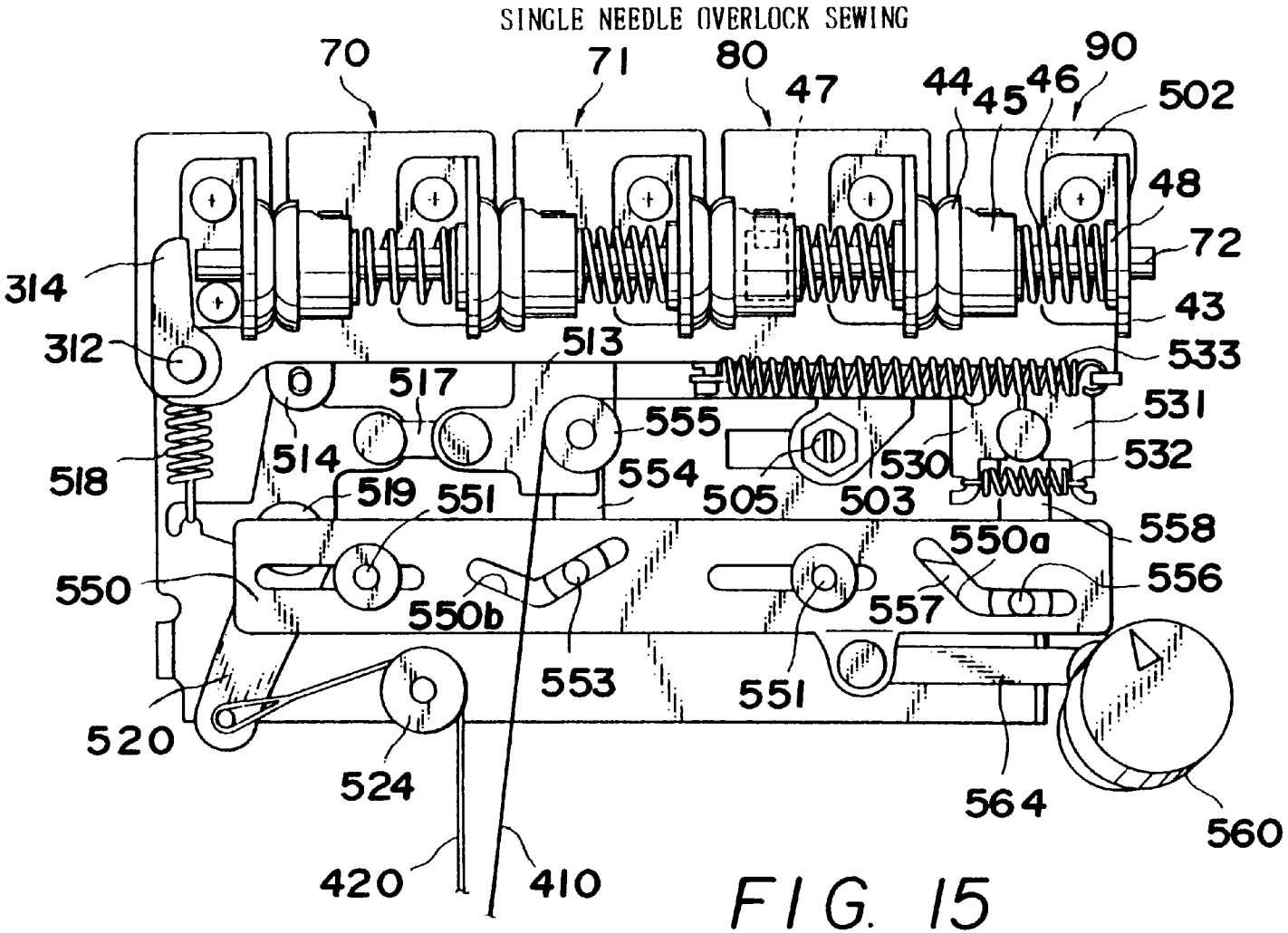
FIG. 15 is an explanatory view which shows positions of a needle thread shifter, an upper looper thread shifter and a lower looper thread shifter in the case where single needle overlock sewing is selected by the stitch changeover means of a thread feeding apparatus for an overlock sewing machine in accordance with the present invention.
Figure 20:
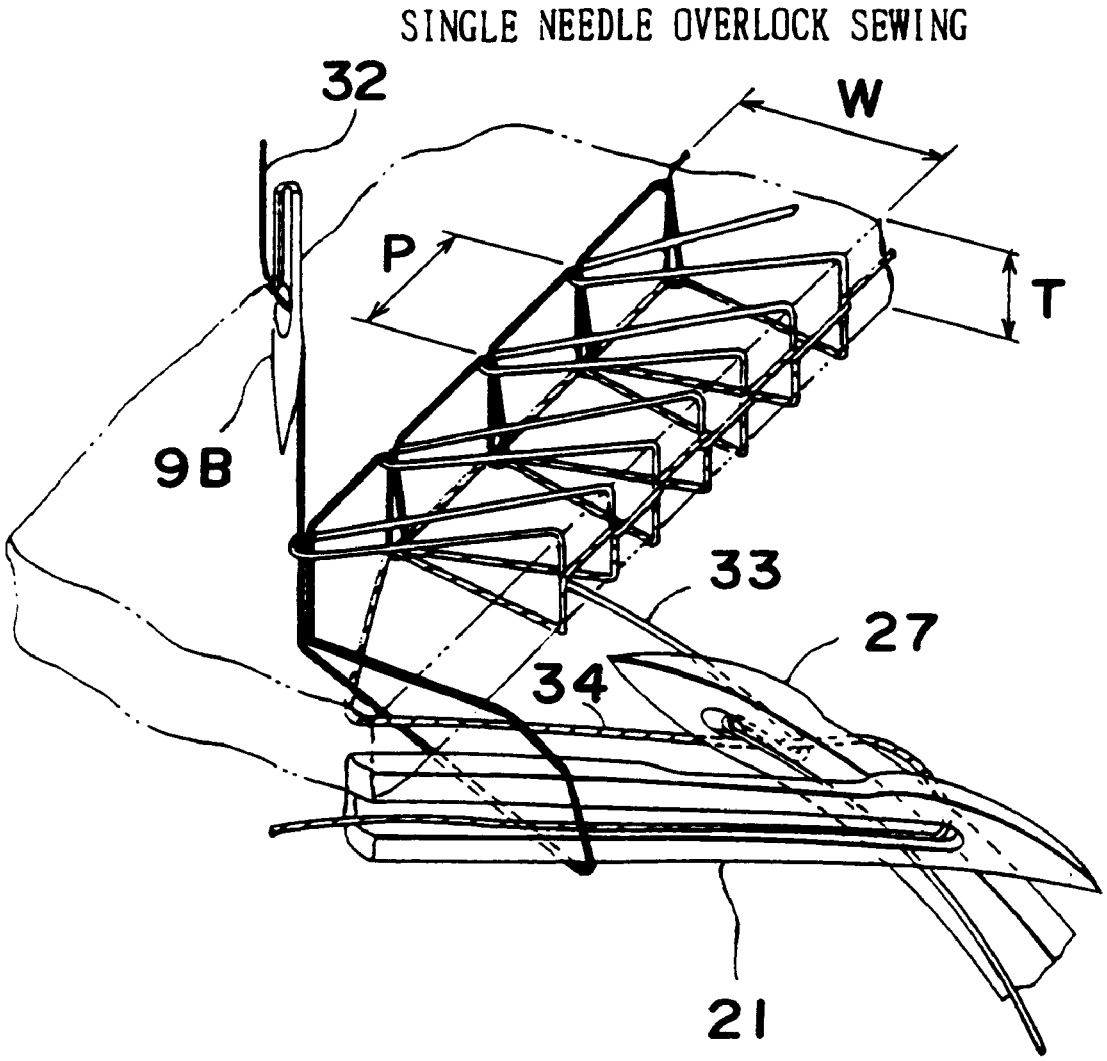
FIG. 20 is an explanatory view which shows stitch formation in single needle overlock sewing by the overlock sewing machine shown in FIG. 1.

Further, in the case that single needle overlock sewing is selected by the stitch selecting dial 560, as shown in FIG. 15, since the stitch selecting cam 550 is moved to a position which is to the right of the position assumed in the case of the double needle overlock sewing, the looper thread adjust cam follower 553, engaged within the looper thread adjust cam slot 550*b* of the stitch changeover cam plate 550, descends along the looper thread adjust cam 550*b*. When the looper thread adjust cam follower 553 descends, the pulley 555 descends to an intermediate position in the cam groove 513*a* of the shift adjust plate 513 so that the stitch width adjust and interlock wire 410 is lower, thereby displacing the upper looper thread shifter 530, on which the stitch width adjust and interlock wire 410 is hooked, to right by the force of the tension spring 533. At this time, the lower looper thread shifter 531 is displaced rightward by force of the tension spring 532. Accordingly, the upper looper thread shifter 530 and the lower looper thread shifter 531, and the upper looper thread reciprocators 503*c* and 504*c* and the lower looper thread reciprocators 503*d* and 504*d* are respectively disposed in positions establishing a relationship whereby the shift quantity of the upper looper thread 33 and the lower looper thread 34 is less as compared with the case of double needle overlock sewing, when the left needle 9A and the right needle 9B are positioned at upper dead center, as shown in FIG. 18 (*b*). This is because, as shown in FIG. 20, the stitch width W of the upper looper thread 33 and that of the lower looper thread 34 are reduced by a needle width WL as compared with the case of double needle overlock sewing.

Figure 16:
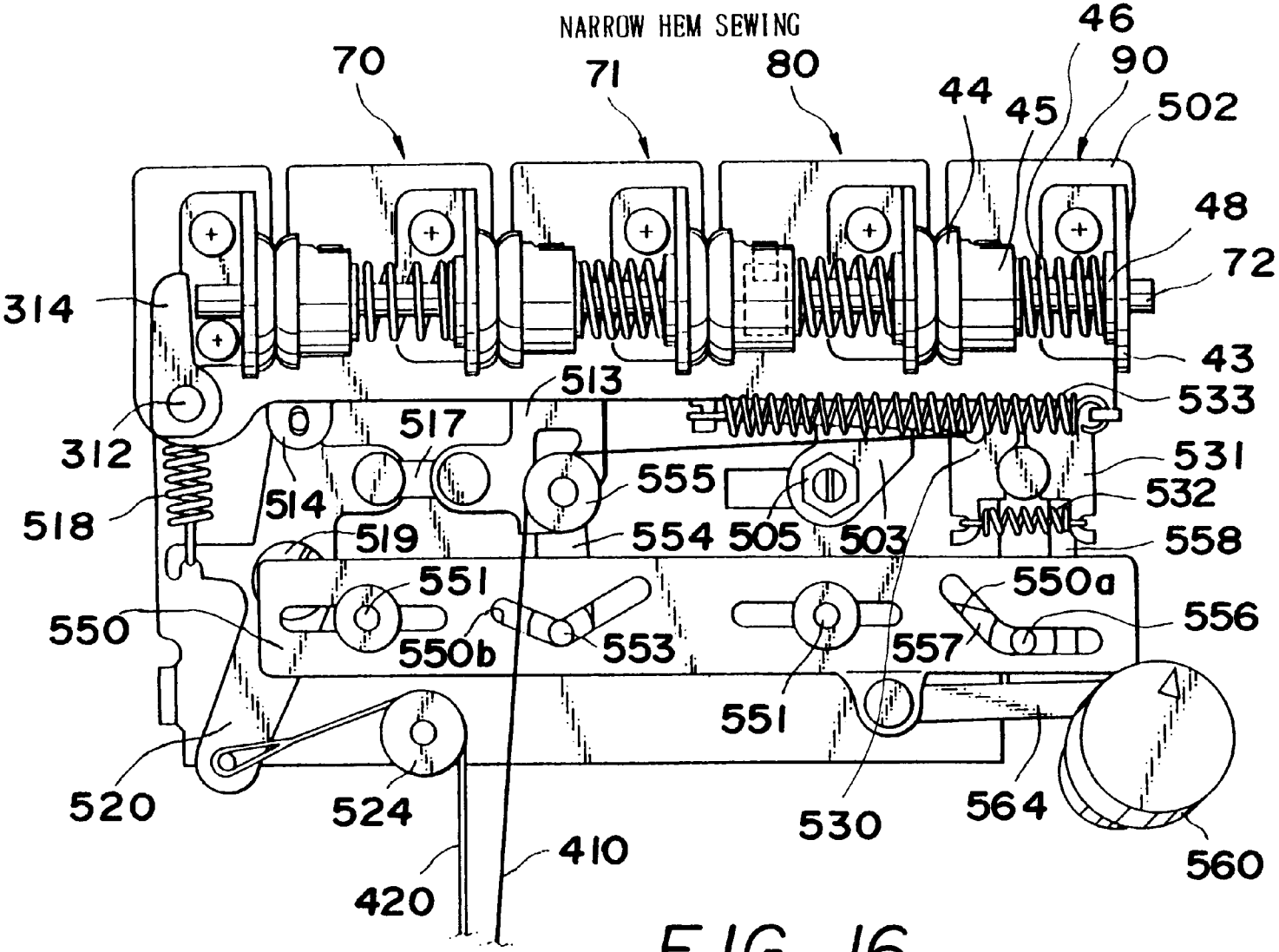
FIG. 16 is an explanatory view which shows positions of a needle thread shifter, an upper looper thread shifter and a lower looper thread shifter in the case where narrow hem sewing is selected by the stitch changeover means of a thread feeding apparatus for an overlock sewing machine in accordance with the present invention.
Figure 21:
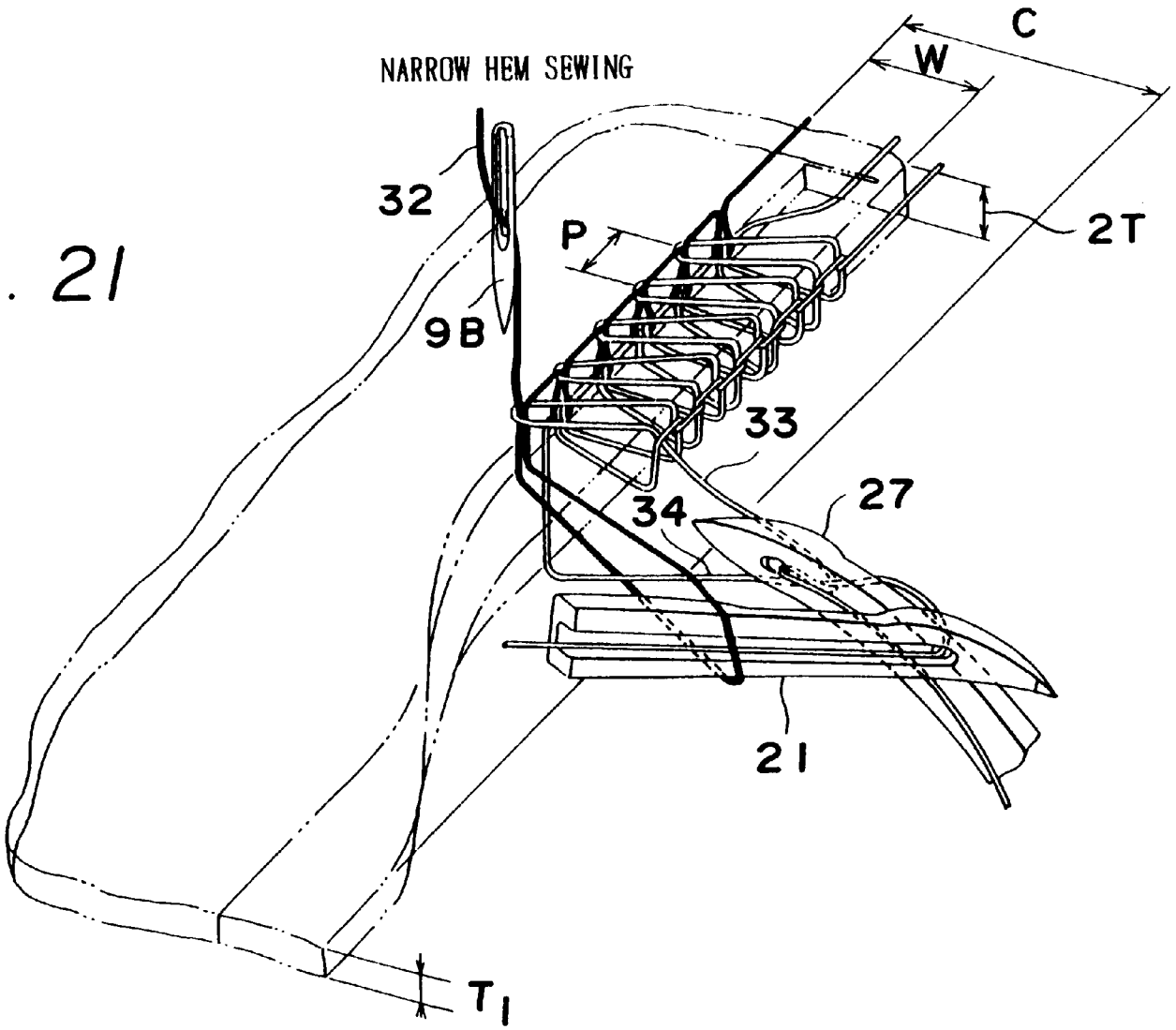
FIG. 21 is an explanatory view which shows stitch formation in narrow hem sewing by the overlock sewing machine shown in FIG. 1.

If narrow hem sewing is selected by the stitch selecting dial 560, as shown in FIG. 16, since the stitch selecting cam 550 is moved to a position which is to the right of the position assumed in the case of the single needle overlock sewing, the looper thread adjust cam follower 553, engaged within the looper thread adjust cam 550*b* of the stitch changeover cam plate 550, moves to the lowermost position of the looper thread adjust cam 550*b*. When the looper thread adjust cam follower 553 descends to the lowermost position, the pulley 555 descends to the lowermost position of the cam groove 513*a* of the shift adjust plate 513 so that the stitch width adjust and interlock wire 410 is lowered, thereby displacing the upper looper thread shifter 530, on which the stitch width adjust and interlock wire 410 is hooked, to the right by the force of the tension spring 533. At this time, the lower looper thread shifter 531 is displaced rightward by the force of the tension spring 532. Accordingly, the upper looper thread shifter 530 and the lower looper thread shifter 531, and the upper looper thread reciprocators 503*c* and 504*c* and the lower looper thread reciprocators 503*d* and 504*d* are respectively disposed in positions providing a relationship by which the shift quantity of the upper looper thread 33 and the lower looper thread 34 is reduced, as compared with the case of single needle overlock sewing, when the left needle 9A and the right needle 9B are positioned at upper dead center, as shown in FIG. 18(*c*). This is because as shown in FIG. 21, the stitch width W of the upper looper thread 33 and the lower looper thread 34 is decreased, as compared with single needle overlock sewing, due to winding of the cloth.

Figure 17:
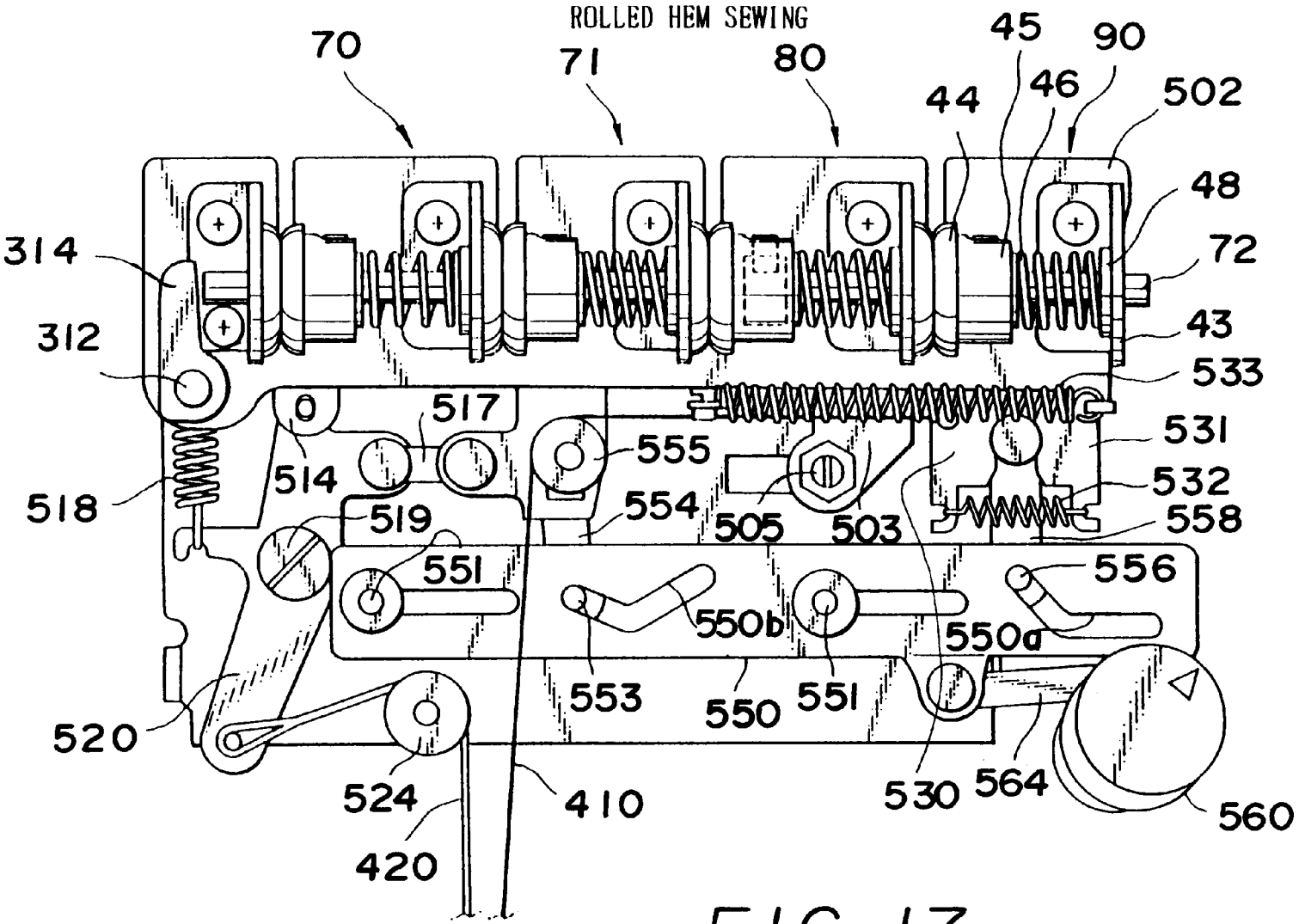
FIG. 17 is an explanatory view which shows positions of a needle thread shifter, an upper looper thread shifter and a lower looper thread shifter in the case where rolled hem sewing is selected by the stitch changeover means of a thread feeding apparatus for an overlock sewing machine in accordance with the present invention.
Figure 22:
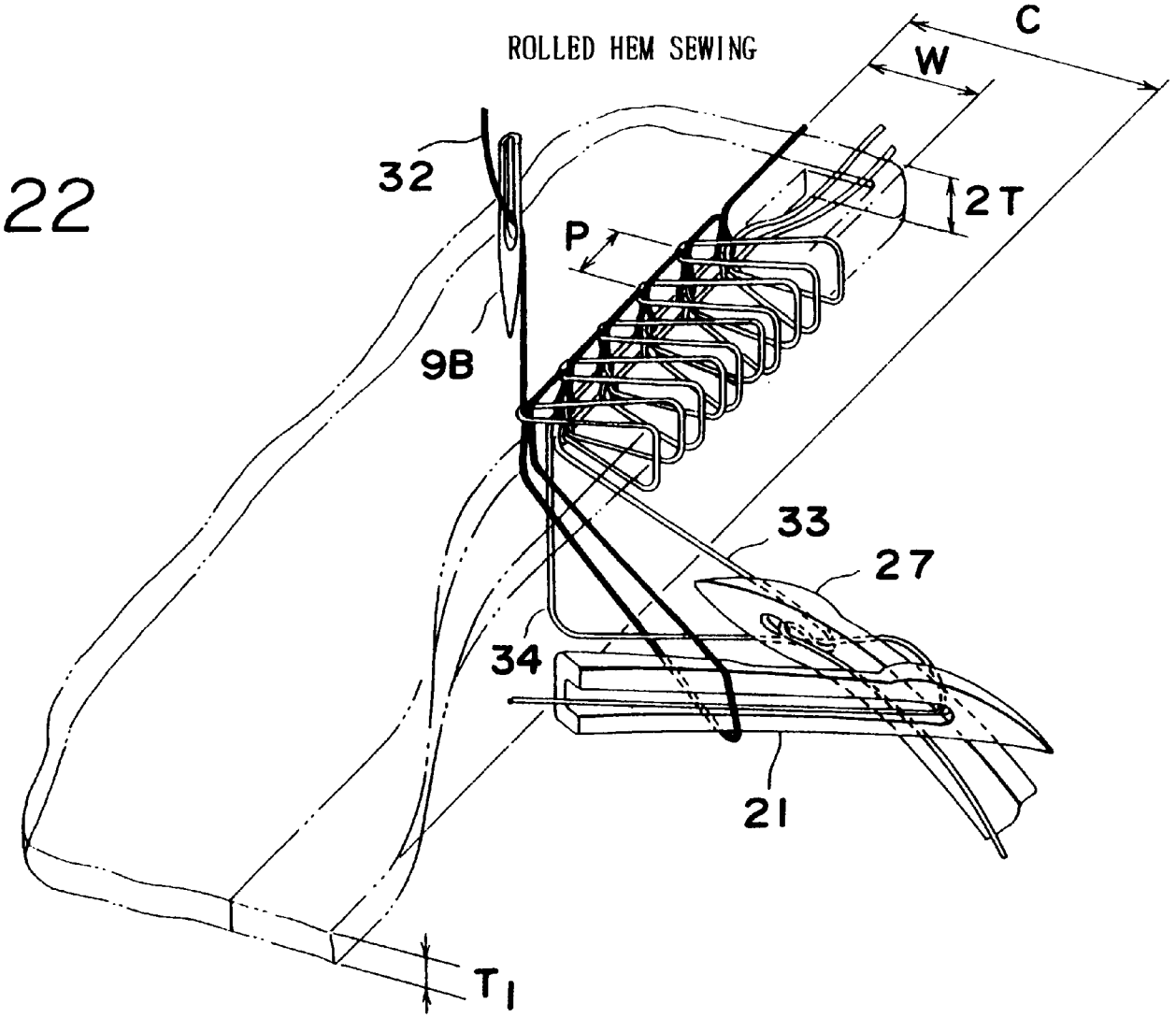
FIG. 22 is an explanatory view which shows stitch formation in rolled hem sewing by the overlock sewing machine shown in FIG. 1.

In the case that rolled hem sewing is selected by the stitch selecting dial 560, as shown in FIG. 17, since the stitch selecting cam 550 is moved to a position which is to the right of the position it occupies in narrow hem sewing, the looper thread adjust cam follower 553, engaged within the looper thread adjust cam 550*b* of the stitch changeover cam plate 550, ascends along the looper thread adjust cam 550*b*. When the looper thread adjust cam follower 553 ascends, the pulley 555 ascends to the intermediate position of the cam groove 513*a* of the shift adjust plate 513 so that the stitch width adjust and interlock wire 410 is raised thereby displacing the upper looper thread shifter 530, on which the stitch width adjust and interlock wire 410 is hooked, to the same position as that in single needle overlock sewing. At this time, the narrow hem cam follower 556, engaged within the narrow hem changeover cam 550*a* of the stitch changeover cam plate 550, ascends along the narrow hem changeover cam 550*a* so that the narrow hem changeover piece 558*a* is moved away from the inlet port 530*d* (FIG. 10) of the upper looper thread shifter 530 and the inlet port 531*c* of the lower looper thread shifter 531 through the end surface cam 530*c* and the end surface cam 531*b*. Accordingly, the upper looper thread shifter 530 and the upper looper thread reciprocators 503*c* and 504*c* are disposed in relative positions whereby the shift quantity of the upper looper thread 33 is larger as compared with the case of narrow hem sewing, when the left needle 9A and the right needle 9B are positioned at upper dead center, as shown in FIG. 18 (*d*). Further, the lower looper thread shifter 531 and the lower looper thread reciprocators 503*d* and 504*d* are disposed in relative positions where the shift quantity of the lower looper thread 34 is less as compared with the case of the narrow hem sewing, when the left needle 9A and the right needle 9B are positioned at upper dead center. This is because as shown in FIG. 22, the upper looper thread 33 necessary for a stitch surrounds inside and outside of the stitch width W of the cloth and the lower looper thread 34 is directly connected to the upper looper thread 33 at a position on the outside surface of the cloth.

The feeding of a thread by the thread feeding apparatus in accordance with the embodiment of the present invention will now be explained with reference to operation of the upper looper thread upstream gripper 50, the upper looper thread downstream gripper 80, the upper looper thread reciprocators 503*c* and 504*c* and the upper looper thread shifter 530.

At the time of cloth feeding, as shown in FIG. 8(*b*) , since the upstream gripper 42 is pressed by the upstream gripper open arm 311, the elastic force from the compression spring 46 against the pair of grip plates 44 of the upper looper thread upstream gripper 50 is weakened due to rightward motion of the thrust receiver 47 and the spring receiver 45 so that the upper looper thread upstream gripper 50 is opened. Further, at this time, since the downstream grip shaft 72 is not pressed by the downstream gripper open arm 314, the elastic force of the compression spring 46 is applied to the pair of grip plates 44 through the spring receiver 45. Accordingly, the upper looper thread downstream gripper 80 is closed. At this time, the upper looper thread reciprocators 503*c* and 504*c* move rightward while pulling out the upper looper thread 32 from the bobbin 52, thereby drawing off a thread "shift quantity" necessary for formation of a stitch by the stitch forming device 100.

Further, at the time of stitch forming, as shown in FIG. 8 (*a*), since the upstream gripper 42 is not pressed by the upstream gripper open arm 311, the elastic force of the compression spring of the upper looper thread upstream gripper 50 is applied to the pair of grip plates 44 through the spring receiver 45. Accordingly, the upper looper thread upstream gripper 50 is closed. Further, at this time, since the downstream grip shaft 72 is not pressed by the downstream gripper open arm 314, the elastic force from the compression spring 46 against the pair of grip plates 44 of the upper looper thread downstream gripper 80 is weakened due to a rightward motion of the thrust receiver 47 and the spring receiver 45 so that the upper looper thread downstream gripper 60 is opened. At this time, the upper looper thread reciprocators 503*c* and 504*c* move leftward, thereby releasing a thread quantity necessary for formation of a stitch by the stitch forming device 100.

Further, it is a matter of course that the same thread feeding operation is performed in the case of the left needle thread upstream gripper 40, the left needle thread reciprocators 503*a* and 504*a*, the needle thread shifter 514 and the left needle thread downstream gripper 70, the right needle thread upstream gripper 41, the right needle thread reciprocators 503*b* and 504*b*, the needle thread shifter 514 and the right needle thread downstream gripper 71, and the lower looper thread upstream gripper 60, the lower looper thread reciprocators 503*d* and 504*d,* the lower looper thread shifter 531 and the lower looper thread downstream gripper 90.

To change the stitch width and to adjust the quantity of thread fed by the above thread feeding apparatus, the stitch width adjust dial 802 is rotated so as to displace the upper looper thread shifter 530 and the lower looper thread shifter 531 through the stitch width adjust and interlock wire 410 of the thread tension adjusting means 400. Accordingly, when the stitch width adjust dial 802 is set such that the stitch width is widened, the stitch width adjust and interlock wire 410 is tensioned so that the upper looper thread shifter 530 and the lower looper thread shifter 531 are displaced leftward. Therefore, since the shift quantity of the upper looper thread 33 and the lower looper thread 34, drawn off by the upper looper thread reciprocators 503*c* and 504*c* and the lower looper thread reciprocators 503*d* and 504*d,* can be increased, the thread quantity in the case that the stitch width W is wide, as shown in FIGS. 19, 20, 21 and 22, can be increased.

Further, when the stitch width adjust dial 802 is set such that the stitch width becomes narrow, the stitch width adjust and interlock wire 410 is loosened so that the upper looper thread shifter 530 and the lower looper thread shifter 531 are pulled by the tension spring 533 so as to be displaced rightward. Therefore, since the shift quantity of the upper looper thread 33 and the lower looper thread 34 drawn off by the upper looper thread reciprocators 503*c* and 504*c* and the lower looper thread reciprocators 503*d* and 504*d* can be decreased, the thread quantity in the case that the stitch width W is narrow, as shown in FIGS. 19, 20, 21 and 22, can be decreased.

To adjust the thread quantity to correspond to a change of the stitch feeding quantity at the time of forming the stitch, the feed quantity adjust dial 930 is rotated so as to rotate the stitch feed adjust arm 421 fixed to the adjust arm 934, thereby rotating the stitch feed adjust and shift lever 520 through the stitch feed adjust and interlock wire 420 of the thread tension adjusting means 400. Accordingly, the needle thread shifter 514 engaging with the needle thread shifter drive shaft 520*a* of the stitch feed adjust and shift lever 520 is displaced. At the same time, since the shift adjust plate 513 connected to the stitch feed adjust and shift lever 520 through the connecting link 517 is displaced, the pulley 555 engaged within the cam groove 513*a* of the shift adjust plate 513 is displaced so that the upper looper thread shifter 530 and the lower looper thread shifter 531 are displaced through the stitch width adjust and interlock wire 410.

Accordingly, when the feed quantity adjust dial 930 is rotated to change the stitch feed pitch P as shown in FIGS. 19, 20, 21 and 22, the needle thread shifter 514 can be interlocked with the stitch feed adjust mechanism 900 through the thread tension adjusting means 400, whereby the thread quantity necessary for forming a stitch is changed in response to the operation of the feed quantity adjust dial 930. At this time, since the thread quantity of, not only the left needle thread 31 and the right needle thread 32, but also the upper looper thread 33 and the lower looper thread 34 is slightly changed due to the change of the stitch feed pitch P, the upper looper thread shifter 530 and the lower looper thread shifter 530 are interlocked with the stitch feed adjust mechanism 900 through the thread tension adjusting means 400.

Figure 23:
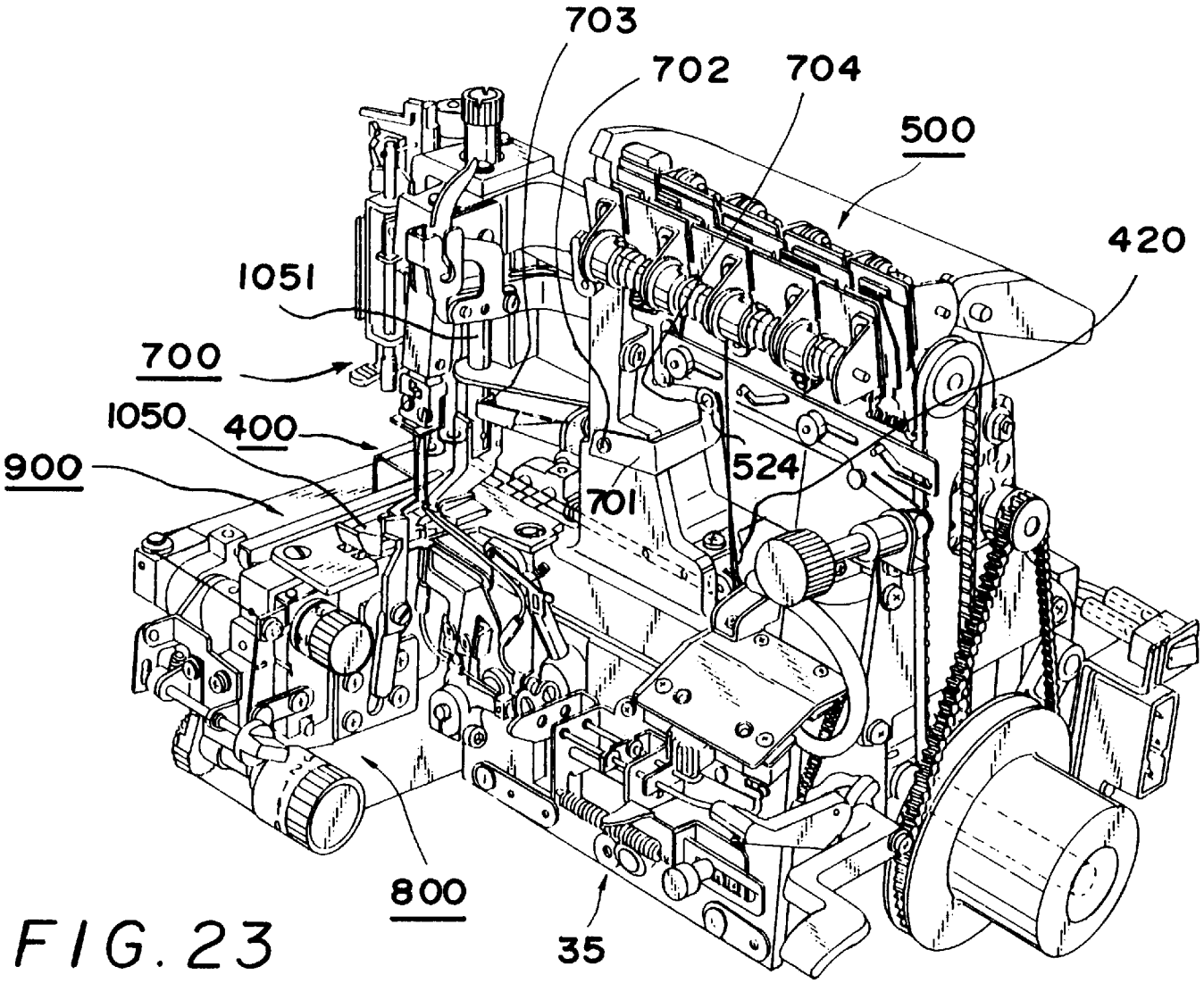
FIG. 23 is a perspective view which shows a state a cloth thickness adjusting and interlocking means incorporated into an overlock sewing machine in accordance with the present invention.

The thread feeding apparatus is provided with a cloth thickness adjust and interlock means 700, as shown in FIGS. 13 and 23, for driving the needle thread shifter 514, the looper thread shifter 530 and the lower looper thread shifter 531 in a manner corresponding to the thread quantity necessary for a stitch, which changes in response to the cloth thickness due to a pressure foot 1050. The cloth thickness adjust and interlock means 700 interlocks the needle thread shifter 514, the looper thread shifter 530 and the lower looper thread shifter 531 with the cloth thickness, utilizing a cloth thickness detecting arm 701 which is rotatably fixed to the machine casing 1 by a stepped pin 702. More specifically, an end of the cloth thickness detecting arm 701 is engaged with a cloth thickness detecting pin 703 fixed to a pressure rod 1051 for mounting the pressure foot 1050 to the machine casing 1 by the pin 702. Further, the other end is rotatably fixed to the pulley 524 for hooking the stitch feed adjust and interlock wire 420 introduced from the pulley 424B by a stepped shaft 704. Accordingly, the pulley 524 is not fixed to the pulley shaft 523 of the thread feed unit base plate 501 in the above overlock sewing machine, thereby interlocking with the pressure foot 1050.

The cloth thickness adjust and interlock means 700 is structured such that when the cloth press position of the pressure foot 1050 is changed at the time of forming the stitch in the cloth, the cloth thickness detecting arm 701 fixed to the pressure rod 1051 rotates to an extent corresponding to the change in the pressure foot. Since the stitch feed adjust and shift lever 520 is rotated by rotation of the cloth thickness detecting arm 701, through the stitch feed adjust and interlock wire 420, the needle thread shifter 514, the looper thread shifter 530 and the lower looper thread shifter 531 are displaced. Accordingly, the needle thread shifter 514, the looper thread shifter 530 and the lower looper thread shifter 521 are displaced in correspondence to the thread quantity necessary for a stitch which changes in response to the cloth thickness due to the pressure foot 1050.

In the present embodiment, the left needle thread reciprocators 503*a* and 504*a,* the right needle thread reciprocators 503*b* and 504*b,* the upper looper thread reciprocators 503*c* and 504*c* and the lower looper reciprocators 503*d* and 504*d* are respectively formed in the pair of reciprocator plates 503 and 504; however, the present invention is not limited to this structure and each of the reciprocators may be separately provided.

Further, in the present embodiment, the thread feeding apparatus for the sewing machine is applied to an overlock sewing machine having double needles and four threads, however, the present invention is not limited to this structure and it can be applied to an overlock sewing machine having one needle and three threads.

The thread feeding apparatus for the sewing machine according to the present invention is also applicable to a lock stitch sewing machine or an embroidery sewing machine having a rotary looptaker, hook, or shuttle, respectively.

As mentioned above, in accordance with the thread feeding apparatus for a sewing machine of the present invention, since the thread can be fed to the stitch forming device as the thread quantity necessary for a stitch only by shifting and releasing the thread by means of the reciprocator, the mechanism can be simplified. Further, since the shifter for adjusting the shift quantity shifted by the reciprocator adjusts in correspondence to the thread quantity necessary for a stitch which changes in response to the stitch width, the stitch length and/or the cloth thickness by the pressure foot, the apparatus can provide both narrow hem and rolled hem sewing. Accordingly, the accuracy of the sewing machine is assured, and the durability of the apparatus can improved so as to accommodate high speed sewing.

Further, since the upper gripper, the lower gripper and the reciprocator can be driven in an interlocked manner with the stitch forming device, a thread can be supplied to the stitch forming device for forming a stitch without necessity of stitch thread tension balancing.

What is claimed is:

1. A thread feeding apparatus for a sewing machine which feeds a thread to a stitch forming device for stitch forming on a cloth, said thread feeding apparatus comprising:

an upstream gripper for gripping the thread fed from a thread spool, said upstream gripper comprising a pair of grip plates biased together by a compression spring, said upstream gripper being closed by said stitch forming device at a time of forming the stitch and opened at a time of feeding of the cloth;

a downstream gripper for gripping the thread introduced from said upstream gripper and comprising a pair of grip plates biased together by a compression spring, said downstream gripper being open at the time of forming the stitch to allow the thread to be pulled by said stitch forming device and being closed at the time of feeding of the cloth; and a reciprocator synchronously driven with said stitch forming device to shift the thread from a thread path extending between said open upstream gripper and said closed downstream gripper at the time of feeding of the cloth to provide a thread quantity necessary for one stitch and to release the thread at the time of forming the stitch;

said reciprocator being disposed between a pair of thread guides arranged between said upstream gripper and said downstream gripper and spaced in direction of feed of the thread.

2. A thread feeding apparatus for a sewing machine as recited in claim 1, wherein said reciprocator has a sloped surface for receiving the thread from an inlet port and for guiding the received thread to a point in the thread path aligning with said pair of thread guides.

3. A thread feeding apparatus for a sewing machine as recited in claim 1, further comprising a shifter for adjusting extent of the shifts from the thread paths by said reciprocator and the corresponding thread quantity, responsive to changes in stitch width, stitch length and/or cloth thickness.

* * * * *